US012698173B2

(12) United States Patent
Koga

(10) Patent No.: US 12,698,173 B2
(45) Date of Patent: Aug. 4, 2026

(54) SHEET CONVEYANCE APPARATUS, IMAGE FORMING APPARATUS, AND IMAGE FORMING SYSTEM

(71) Applicant: CANON KABUSHIKI KAISHA, Tokyo (JP)

(72) Inventor: Yutaka Koga, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 19/217,074

(22) Filed: May 23, 2025

(65) Prior Publication Data

US 2025/0376345 A1 Dec. 11, 2025

(30) Foreign Application Priority Data

Jun. 5, 2024 (JP) ..... 2024-091194

(51) Int. Cl.
*B65H 9/00* (2006.01)

(52) U.S. Cl.
CPC ..... *B65H 9/002* (2013.01); *B65H 2301/331* (2013.01); *B65H 2402/10* (2013.01); *B65H 2404/14212* (2013.01); *B65H 2511/24* (2013.01)

(58) Field of Classification Search
CPC ..... B65H 9/002; B65H 2402/10
See application file for complete search history.

(56) References Cited

U.S. PATENT DOCUMENTS

| | | | | |
|---|---|---|---|---|
| 6,053,494 A * | 4/2000 | Baskette | ..... | B65H 29/60 271/274 |
| 6,533,268 B2 * | 3/2003 | Williams | ..... | B65H 9/002 271/228 |
| 6,779,791 B2 * | 8/2004 | Kawamura | ..... | B65H 9/002 271/228 |
| 7,040,478 B2 * | 5/2006 | Ehlert | ..... | B65G 13/10 198/370.09 |
| 7,950,518 B2 * | 5/2011 | Fehrenbach | ..... | B65H 9/002 198/411 |
| 8,348,267 B2 * | 1/2013 | Storey | ..... | B65H 9/166 271/228 |

(Continued)

FOREIGN PATENT DOCUMENTS

JP 2010155677 A 7/2010

*Primary Examiner* — Patrick Cicchino
(74) *Attorney, Agent, or Firm* — ROSSI, KIMMS & McDOWELL LLP

(57) ABSTRACT

A sheet conveyance apparatus includes a skew feeding correction unit. The skew feeding correction unit includes a roller unit, and an attachment and detachment portion to and from which the roller unit is attachable and detachable. The roller unit includes a first skew feeding correction roller configured to convey a sheet, a second skew feeding correction roller configured to convey the sheet, a first turning mechanism configured to turn the first skew feeding correction roller around a first shaft extending in an intersecting direction intersecting a conveyance direction of the sheet and a width direction orthogonal to the conveyance direction, a second turning mechanism configured to turn the second skew feeding correction roller around a second shaft extending in the intersecting direction, and a support member supporting the first skew feeding correction roller, the first turning mechanism, the second skew feeding correction roller, and the second turning mechanism.

10 Claims, 15 Drawing Sheets

(56) References Cited

U.S. PATENT DOCUMENTS

| | | | | |
|---|---|---|---|---|
| 8,800,748 | B2 * | 8/2014 | Yap | G07B 17/00508 198/370.09 |
| 9,580,263 | B2 * | 2/2017 | Park | B65H 9/166 |
| 9,790,044 | B2 * | 10/2017 | Ortmann | B65H 3/565 |
| 11,091,325 | B2 * | 8/2021 | Kim | B65G 39/12 |
| 12,172,864 | B2 * | 12/2024 | Wada | G07D 11/17 |

* cited by examiner

FIG.7A SKEW FEEDING AMOUNT MEASUREMENT EXAMPLE
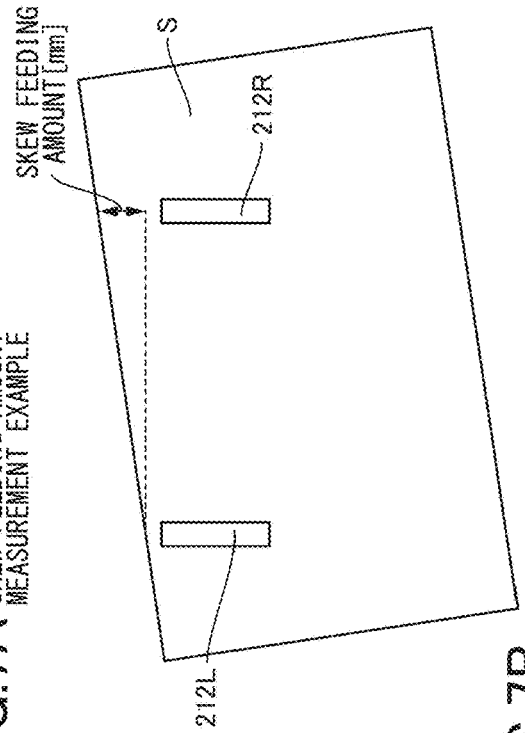
FIG.7C SKEW FEEDING CORRECTION OPERATION
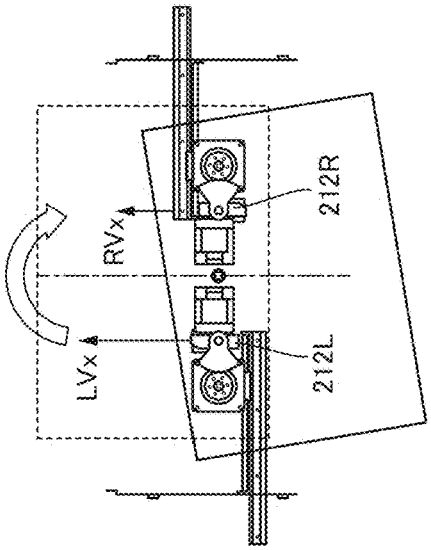
FIG.7B EXAMPLE OF SKEW FEEDING CORRECTION PROFILE
SKEW FEEDING: 15 mm/297 CORRECTION
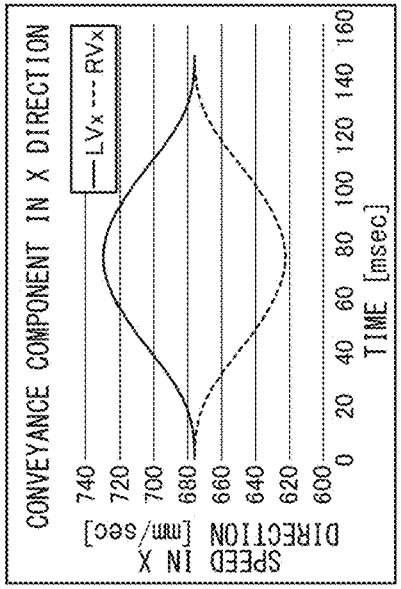
SKEW FEEDING: 10 mm/297 CORRECTION
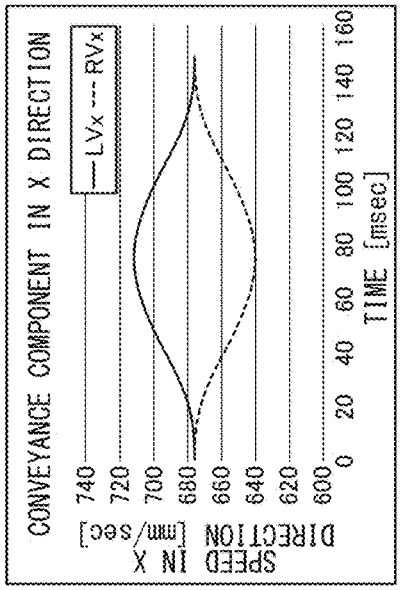
SKEW FEEDING: 5 mm/297 CORRECTION
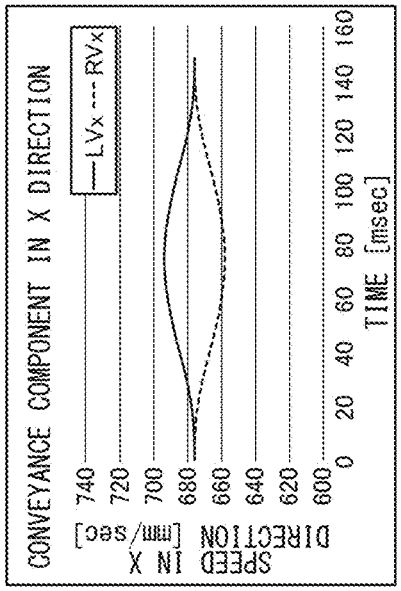

FIG.8A LATERAL REGISTRATION DEVIATION AMOUNT MEASUREMENT EXAMPLE
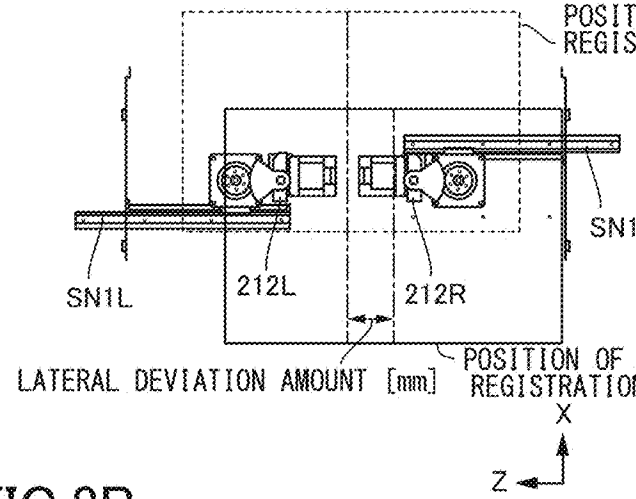
FIG.8C LATERAL REGISTRATION CORRECTION OPERATION
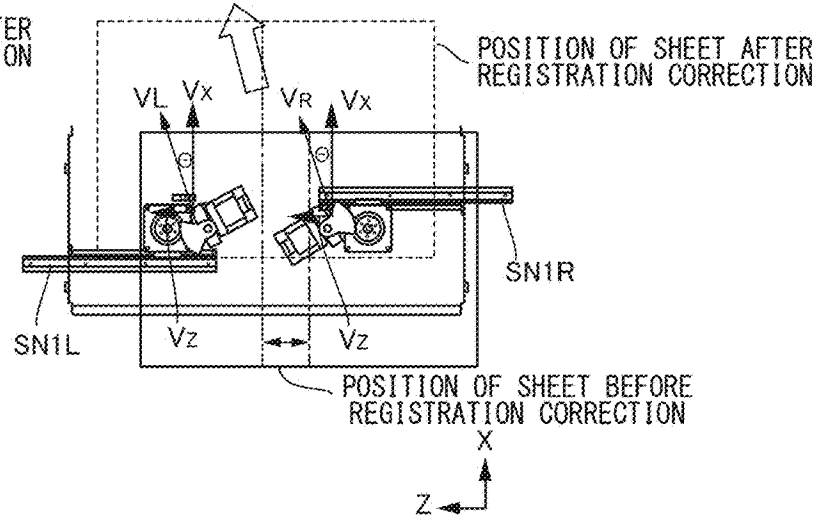
FIG.8B EXAMPLE OF LATERAL REGISTRATION DEVIATION CORRECTION PROFILE
LATERAL REGISTRATION: 15 mm CORRECTION
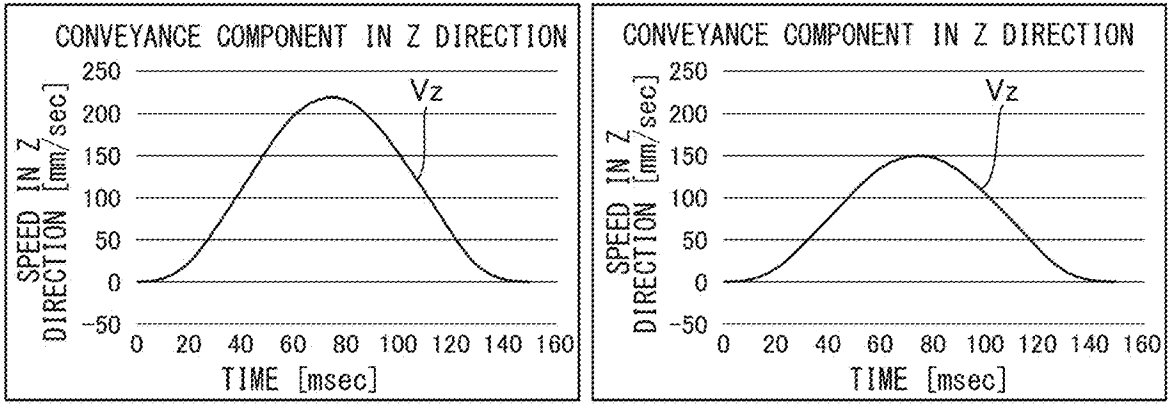
LATERAL REGISTRATION: 10 mm CORRECTION
LATERAL REGISTRATION: 5 mm CORRECTION
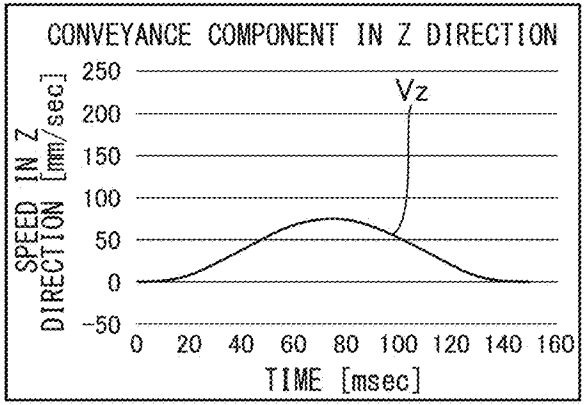

SHEET CONVEYANCE APPARATUS, IMAGE FORMING APPARATUS, AND IMAGE FORMING SYSTEM

BACKGROUND

Field of the Technology

The present disclosure relates to a sheet conveyance apparatus that corrects skew feeding of a conveyed sheet, an image forming apparatus, and an image forming system.

Description of the Related Art

For example, in an image forming apparatus that forms an image on a sheet, a sheet conveyance apparatus that corrects skew feeding of the sheet conveyed to an image forming unit is provided in order to form the image without inclination with respect to the sheet. As the sheet conveyance apparatus that performs such skew feeding correction, a sheet conveyance apparatus including a plurality of skew feeding correction rollers that are arranged in parallel in a width direction of a sheet and are independently rotatable has also been proposed (see Japanese Patent Laid-Open No. 2010-155677). In Japanese Patent Laid-Open No. 2010-155677, skew feeding of a sheet is corrected by differentiating rotational speeds of the skew feeding correction rollers.

However, there remains room for improvement in the configuration for correcting skew feeding of the sheet.

SUMMARY

The present disclosure is directed to provide a sheet conveyance apparatus, an image forming apparatus, and an image forming system having an improved configuration for correcting skew feeding of the sheet.

According to a first aspect of the present disclosure, a sheet conveyance apparatus includes a skew feeding correction unit configured to correct skew feeding of a sheet. The skew feeding correction unit includes a roller unit, and an attachment and detachment portion to and from which the roller unit is attachable and detachable. The roller unit includes a first skew feeding correction roller configured to convey the sheet, a second skew feeding correction roller configured to convey the sheet, a first turning mechanism configured to turn the first skew feeding correction roller around a first shaft extending in an intersecting direction intersecting a conveyance direction of the sheet and a width direction orthogonal to the conveyance direction, a second turning mechanism configured to turn the second skew feeding correction roller around a second shaft extending in the intersecting direction, and a support member supporting the first skew feeding correction roller, the first turning mechanism, the second skew feeding correction roller, and the second turning mechanism.

According to a second aspect of the present disclosure, an image forming apparatus includes the sheet conveyance apparatus, and an image forming unit configured to form an image on a sheet conveyed by the sheet conveyance apparatus.

According to a third aspect of the present disclosure, an image forming system includes the image forming apparatus, and a processing apparatus configured to perform processing on a sheet on which an image is formed by the image forming apparatus.

Features of the present disclosure will become apparent from the following description of embodiments with reference to the attached drawings. The following description of embodiments are described by way of example.

BRIEF DESCRIPTION OF THE DRAWINGS

FIG. 7A is a schematic diagram illustrating a skew feeding amount measurement example.

FIG. 7B is a diagram illustrating an example of a skew feeding correction profile.

FIG. 7C is a schematic diagram illustrating a skew feeding correction operation.

FIG. 8A is a schematic diagram illustrating a lateral registration deviation amount measurement example.

FIG. 8B is a diagram illustrating an example of a lateral registration deviation correction profile.

FIG. 8C is a schematic diagram illustrating a lateral registration deviation correction operation.

DESCRIPTION OF THE EMBODIMENTS

Hereinafter, embodiments of the present disclosure will be described with reference to the drawings. In the present embodiment, a case where an inkjet recording system 1 is applied as an image forming system will be described.

Inkjet Recording System

Figure 1A:
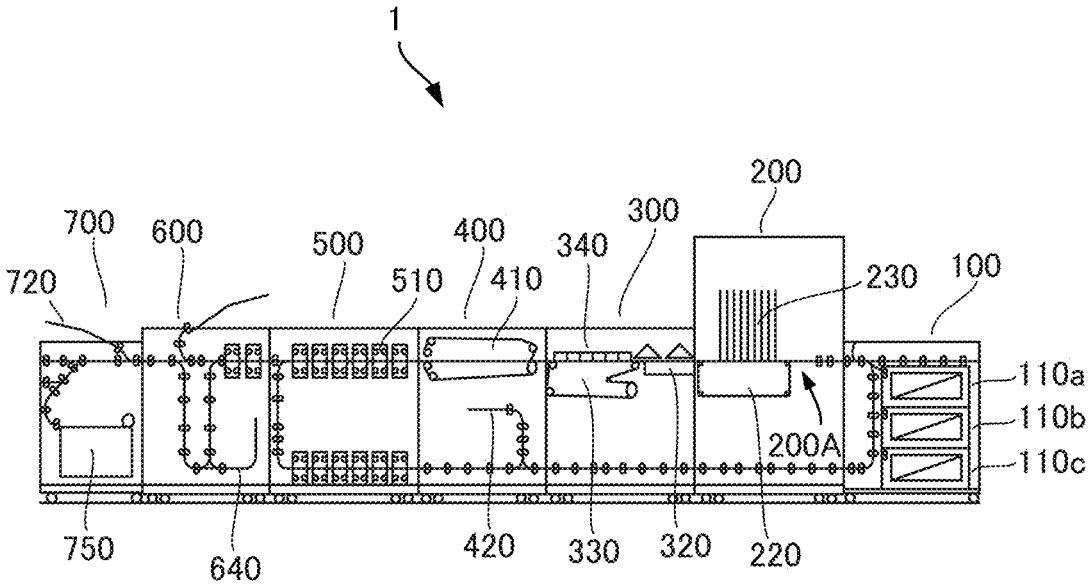
FIG. 1A is a schematic view illustrating a schematic configuration of an inkjet recording system according to the present embodiment.
Figure 1B:
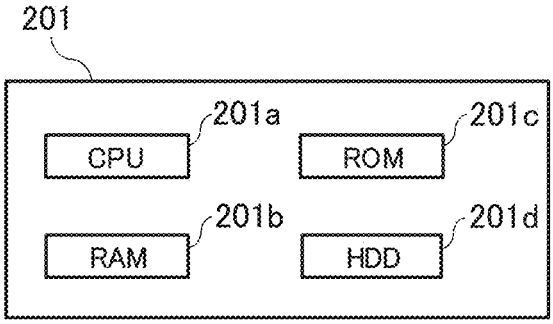
FIG. 1B is a block diagram illustrating a control unit of a print module.

First, a schematic configuration of the inkjet recording system 1 according to the present embodiment will be described with reference to FIGS. 1A and 1B. FIG. 1A is a schematic view illustrating the schematic configuration of the inkjet recording system 1 according to the present embodiment. FIG. 1B is a block diagram illustrating a control unit of a print module.

The inkjet recording system 1 serving as the image forming system is a sheet-fed inkjet recording system that produces a recorded matter by forming an ink image on a sheet S using two liquids of a reaction liquid and an ink. As illustrated in FIG. 1A, the inkjet recording system 1 includes a feeding module 100, a print module 200, a drying module 300, a fixing module 400, a cooling module 500, a reversing module 600, and a discharge module 700. The cut-sheet-like sheet S supplied from the feeding module 100 is conveyed along a conveyance path, processed in each module, and discharged by the discharge module 700. Further, in the inkjet recording system 1, the image is formed on the sheet by the print module 200 serving as an image forming apparatus, and various types of processing are performed on the sheet on which the image is formed at positions downstream of the print module 200 in a sheet conveyance direction. Therefore, the drying module 300, the fixing module 400, the cooling module 500, the reversing module 600, the discharge module 700, and the like can also be referred to as processing apparatuses.

The feeding module 100 includes three storage compartments 110*a*, 110*b*, and 110*c* that store the sheets S. Each of the storage compartments 110*a*, 110*b*, and 110*c* is configured to be drawable toward a front side of the apparatus. The sheets S are fed one by one by a separation belt and a conveyance roller (not illustrated) in each of the storage compartments 110*a*, 110*b*, and 110*c*, and conveyed to the print module 200. The number of storage compartments 110*a*, 110*b*, and 110*c* is not limited to three, and may be one, two, or four or more.

The print module 200 includes a registration unit 210 (see FIG. 2) serving as a skew feeding correction unit that performs skew feeding correction and lateral registration correction before image formation described below in detail, a print belt unit 220, and a recording unit 230. The sheet S conveyed from the feeding module 100 is conveyed to the print belt unit 220 after an inclination and a position of the sheet are corrected by a plurality of conveyance roller pairs 208 and 209 (see FIG. 2) and the registration unit 210. The recording unit 230 is disposed at a position facing the print belt unit 220 across the conveyance path. The plurality of conveyance roller pairs 208 and 209 and the registration unit 210 implement a sheet conveyance unit 200A serving as a sheet conveyance apparatus that conveys the sheet to the recording unit 230. In addition, the recording unit 230 implements an image forming unit that performs recording processing (printing) on the conveyed sheet S from above by a plurality of recording heads 230H (see FIG. 2) to form the image on the sheet S.

The plurality of recording heads 230H are arranged in the sheet conveyance direction. In the present embodiment, a total of five line type recording heads corresponding to the reaction liquid in addition to four colors of yellow (Y), magenta (M), cyan (C), and black (Bk) are provided. Note that the number of colors is not limited to four, and the number of recording heads is not limited to five. A system using a heating element, a system using a piezoelectric element, a system using an electrostatic element, a system using a micro-electromechanical systems (MEMS) element, and the like can be adopted as an inkjet system. The ink of each color is supplied from an ink tank (not illustrated) to the recording head via an ink tube. The sheet S subjected to printing by the recording unit 230 is sucked and conveyed by the print belt unit 220, thereby being conveyed while securing a clearance with respect to the recording head. In the sheet S subjected to printing by the recording unit 230, a deviation or a color density of the image formed on the sheet S is detected by an in-line scanner (not illustrated) disposed downstream of the recording unit in the sheet conveyance direction. The detection result is used to correct the printed image.

The drying module 300 includes a decoupling unit 320, a drying belt unit 330, and a warm air blowing unit 340, and reduces the amount of liquid contained in the ink applied onto the sheet S by the recording unit 230 of the print module 200, and enhances fixability between the sheet S and the ink. The sheet S subjected to printing by the recording unit 230 of the print module 200 is conveyed to the decoupling unit 320 disposed at an upstream position in the drying module 300 in the sheet conveyance direction. In the decoupling unit 320, the sheet S can be conveyed by a wind pressure from above and a friction of the belt, and the sheet S on the belt is weakly held and conveyed to prevent deviation of the sheet S on the print belt unit 220 where the ink image is formed. The drying belt unit 330 is disposed below the belt, and the warm air blowing unit 340 is disposed above the belt so as to face each other with the belt interposed therebetween. The sheet S conveyed from the decoupling unit 320 is sucked and conveyed by the drying belt unit 330, and at the same time, an ink-applied surface is dried by receiving hot air from the warm air blowing unit 340. As a drying method, a combination of a method of irradiating the surface of the sheet S with electromagnetic waves (ultraviolet rays, infrared rays, or the like) and a conductive heat transfer method by contact of a heating body may be used in addition to a method of applying hot air.

The fixing module 400 includes a fixing belt unit 410. The fixing belt unit 410 includes an upper belt unit and a lower belt unit, and the sheet S conveyed from the drying module 300 can be passed between the heated upper belt unit and lower belt unit to fix the ink to the sheet S.

The cooling module 500 includes a plurality of cooling units 510, and cools the high-temperature sheet S conveyed from the fixing module 400. The cooling unit 510 is configured to cool the sheet S by taking outside air into a cooling box with a fan, increasing a pressure in the cooling box, and blowing air blown from a nozzle formed in a conveyance guide toward the sheet S. The cooling units 510 are disposed on both an upper side and a lower side of the conveyance path, and cool the sheet S from both sides.

The cooling module 500 includes a conveyance path switching unit and can switch the conveyance path of the sheet S for the case of conveying the sheet S to the reversing module 600 and the case of conveying the sheet S to a duplex printing conveyance path used at the time of duplex printing. At the time of the duplex printing, the sheet S is conveyed to a conveyance path below the cooling module 500. In this case, the sheet is further conveyed from the cooling module 500 along the duplex printing conveyance paths of the fixing module 400, the drying module 300, the print module 200, and the feeding module 100. The duplex printing conveyance path of the fixing module 400 is provided with a first reversing unit 420 that reverses the front and back of the sheet S. Then, the sheet is conveyed again from the feeding module 100 to a pre-image-formation registration correction unit, the print belt unit 220, and the recording unit 230 of the print module 200, and is subjected to printing by the recording unit 230.

The reversing module 600 includes a second reversing unit 640 and can reverse the front and back of the conveyed sheet S to change a front-back orientation of the sheet S to be discharged. The discharge module 700 includes a top tray 720 and a stacking portion 750, and aligns and stacks the sheet S conveyed from the reversing module 600 on the top tray 720 and the stacking portion 750, or discharges the sheet S to an external tray (not illustrated) or the like.

As illustrated in FIG. 1B, the print module 200 includes a control unit 201 serving as a controller that performs various types of control in the inkjet recording system 1 and the print module 200. The control unit 201 includes a CPU 201*a* as an example of a processor, an RAM 201*b*, an ROM 201*c*, and an HDD 201*d* serving as storage units, and the like. The CPU 201*a*, the RAM 201*b*, the ROM 201*c*, and the HDD 201*d* are connected by a bus so as to be able to communicate information with each other, and are connected to a controller of each module, an operation unit (not illustrated), or the like via an interface (not illustrated) so as to be able to communicate information. The control unit 201 is connected to various motors and various sensors of the registration unit 210 described below in detail via an interface (not illustrated). Specifically, registration drive motors M1L and M1R, steering motors M2L and M2R, image sensors SN1L and SN1R, leading edge registration sensors SN2L and SN2R, home position sensors SN3L and SN3R, and the like described below in detail are connected to the control unit 201. Detailed control of the registration unit 210 by the control unit 201 is described below.

Registration Unit of Print Module and Peripheral Configuration Thereof

Figure 2:
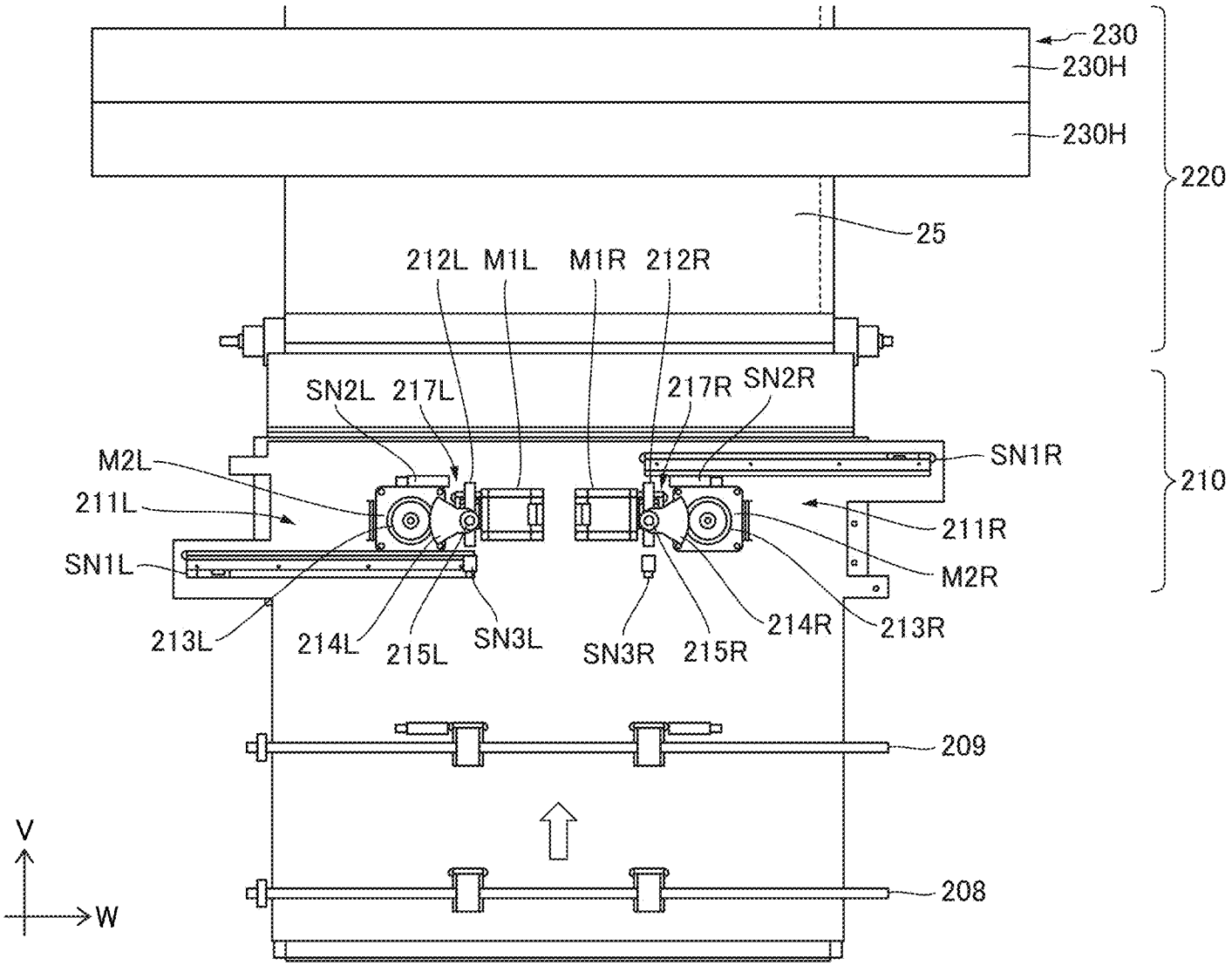
FIG. 2 is a top view illustrating a registration unit of the print module according to the present embodiment.
Figure 3:
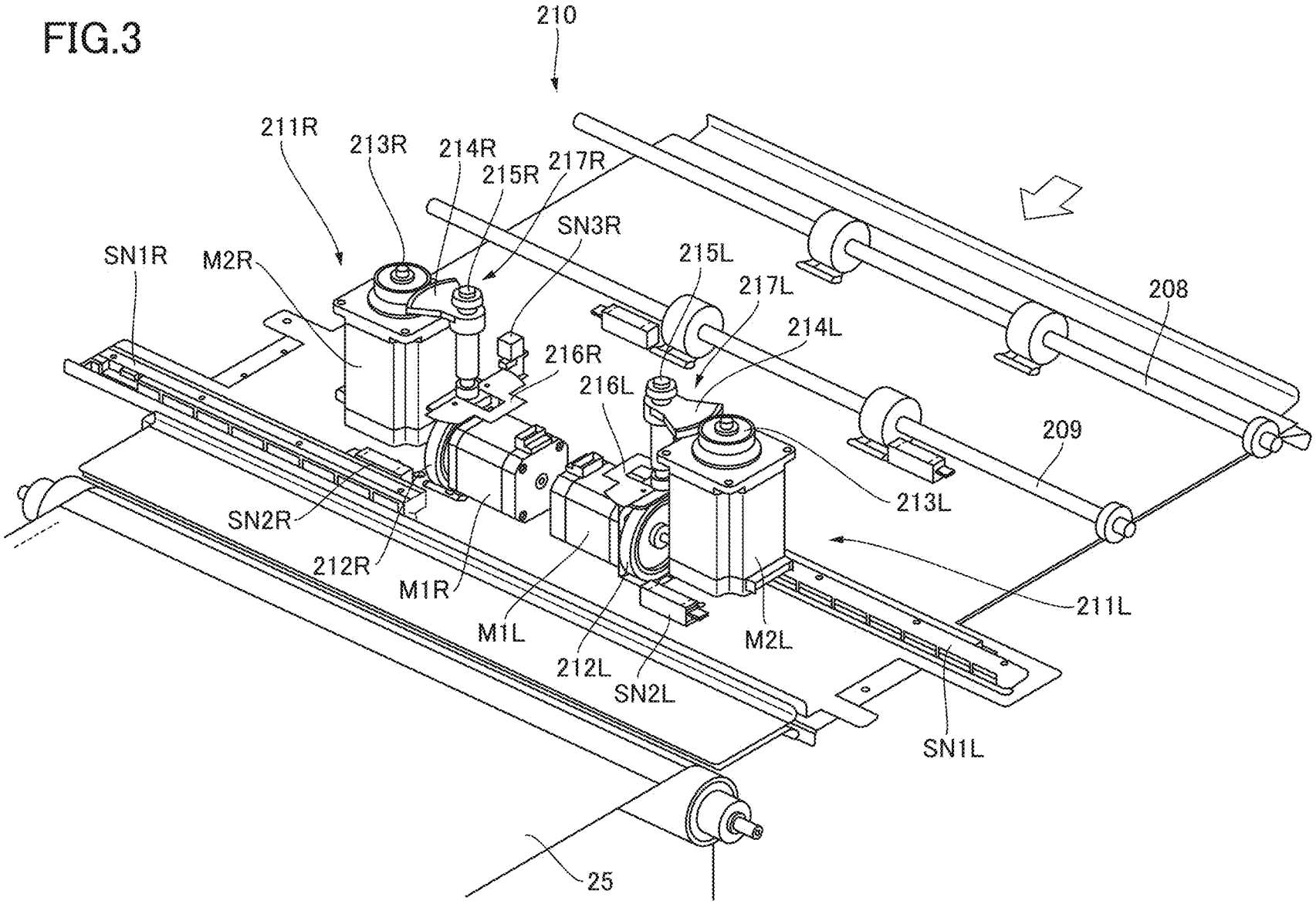
FIG. 3 is a perspective view illustrating the registration unit of the print module according to the present embodiment.
Figure 6:
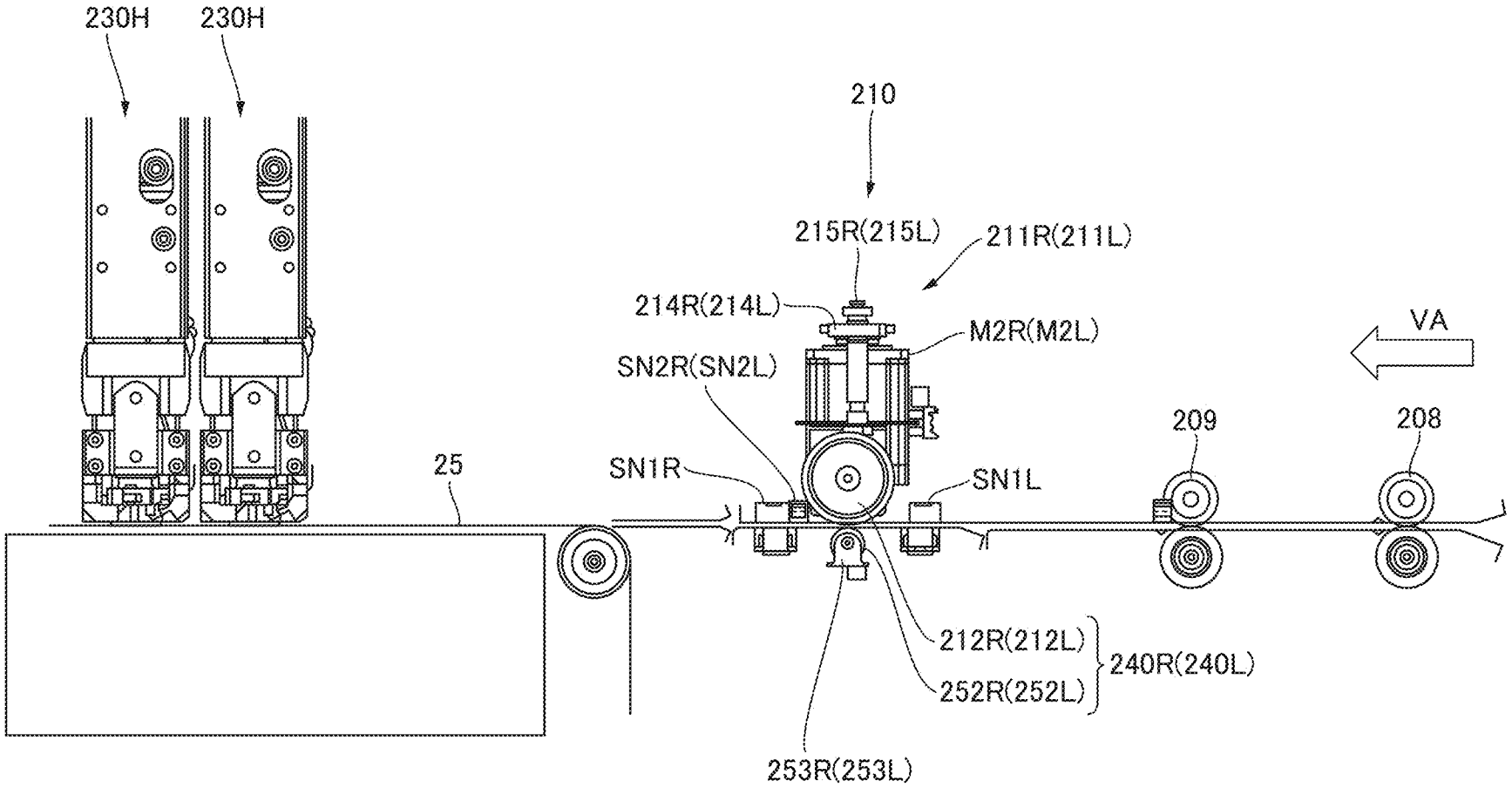
FIG. 6 is a side cross-sectional view illustrating the registration unit of the print module according to the present embodiment.

Next, the registration unit 210 in the print module 200 and a peripheral configuration thereof will be described with reference to FIGS. 2, 3, and 6. FIG. 2 is a top view illustrating the registration unit of the print module according to the present embodiment. FIG. 3 is a perspective view illustrating the registration unit of the print module according to the present embodiment. FIG. 6 is a side cross-sectional view illustrating the registration unit of the print module according to the present embodiment.

In the print module 200, the conveyance roller pairs 208 and 209 for conveying the sheet are sequentially arranged in a sheet conveyance direction V in the sheet conveyance unit 200A (see FIG. 1) as illustrated in FIGS. 2 and 3. The conveyance roller pairs 208 and 209 each include a lower roller including a roller core made of ethylene-propylene-diene monomer (EPDM), for example, and an upper roller that is a rubber roller made of urethane, for example, and the lower roller is urged toward the upper roller by a spring (not illustrated). Note that the sheet conveyance direction V referred to herein refers to a direction in a case where the sheet S is not skewed, and does not refer to a conveyance direction in a steering operation described below.

In the sheet conveyance unit 200A of the print module 200, the registration unit 210 that corrects skew feeding of the sheet conveyed by the conveyance roller pairs 208 and 209 is disposed downstream of the conveyance roller pairs 208 and 209 in the sheet conveyance direction V. Furthermore, in the print module 200, the print belt unit 220 is disposed downstream of the registration unit 210 in the sheet conveyance direction V. The print belt unit 220 includes a print belt 25 that rotates so as to suck and convey the sheet, and the recording unit 230 (the plurality of recording heads 230H) (see FIG. 2) that forms the image on the sheet conveyed by the print belt 25.

Registration Roller Pair

As illustrated in FIG. 6, the registration unit 210 includes a left registration roller pair (hereinafter, simply referred to as "registration roller pair") 240L on a left side of a conveyance center in the sheet conveyance direction V (see FIG. 2). The registration unit 210 includes a right registration roller pair (hereinafter, simply referred to as "registration roller pair") 240R arranged in parallel on a right side of the conveyance center in the sheet conveyance direction V (see FIG. 2). The registration roller pair 240L includes a registration driving roller 212L serving as a first skew feeding correction roller, and a registration driven roller 252L that is disposed to face the registration driving roller 212L and is driven when abutting on the registration driving roller 212L. Furthermore, similarly, the registration roller pair 240R includes a registration driving roller 212R serving as a second skew feeding correction roller, and a registration driven roller 252R that is disposed to face the registration driving roller 212R and is driven when abutting on the registration driving roller 212R. Note that the registration driving rollers 212L and 212R are implemented by, for example, rubber rollers made of polyurethane, and the registration driven rollers 252L and 252R are implemented by, for example, rollers made of EPDM.

The registration driven rollers 252L and 252R of the registration roller pairs 240L and 240R are configured to be movable between an abutting position where the registration driven rollers 252L and 252R abut on the registration driving rollers 212L and 212R and a separation position where the registration driven rollers 252L and 252R are separated from the registration driving rollers 212L and 212R by a separation mechanism (not illustrated).

Drive Turning Mechanism

Next, drive turning mechanisms 211L and 211R in the registration unit 210 will be described. As illustrated in FIGS. 2 and 3, the registration unit 210 includes the drive turning mechanism 212L that rotationally drives and turns the registration driving roller 211L serving as the first skew feeding correction roller capable of conveying the sheet. Similarly, the registration unit 210 includes the drive turning mechanism 212R that rotationally drives and turns the registration driving roller 211R serving as the second skew feeding correction roller capable of conveying the sheet.

The drive turning mechanism 211L includes the registration drive motor M1L serving as a first rotation drive motor. The drive turning mechanism 211L includes the steering motor M2L serving as a first turning drive motor, and a turning transmission mechanism 217L serving as a first turning mechanism that turns the registration driving roller 212L by driving rotation of the steering motor M2L. The turning transmission mechanism 217L includes a motor gear 213L, a drive input gear 214L, and a steering shaft 215L. That is, the turning transmission mechanism 217L turns the registration driving roller 212L around the steering shaft 215L serving as a first shaft extending in an intersecting direction intersecting the conveyance direction of the sheet and the width direction orthogonal to the conveyance direction (in the present embodiment, a direction orthogonal to the conveyance direction of the sheet and the width direction orthogonal to the conveyance direction).

Similarly, the drive turning mechanism 211R includes the registration drive motor M1R serving as a second rotation drive motor. The drive turning mechanism 211R includes the steering motor M2R serving as a second turning drive motor, and a turning transmission mechanism 217R serving as a second turning mechanism that turns the registration driving roller 212R by driving rotation of the steering motor M2R. The turning transmission mechanism 217R includes a motor gear 213R, a drive input gear 214R, and a steering shaft 215R. That is, the turning transmission mechanism 217R turns the registration driving roller 212R around the steering shaft 215R serving as a second shaft extending in an intersecting direction intersecting the conveyance direction of the sheet and the width direction orthogonal to the conveyance direction (in the present embodiment, a direction orthogonal to the conveyance direction of the sheet and the width direction orthogonal to the conveyance direction).

Rotation shafts of the registration drive motors M1L and M1R are connected to the registration driving rollers 212L and 212R, respectively, in a drivable manner. That is, the registration driving rollers 212L and 212R are rotationally driven by the rotation of the registration drive motors M1L and M1R such that rotational speeds of the registration driving rollers 212L and 212R can be changed independently.

In addition, the steering shafts 215L and 215R rotatably support frames 216L and 216R (see FIG. 3) that support the registration driving rollers 212L and 212R and the registration drive motors M1L and M1R, respectively. That is, the registration driving roller 212L and the registration drive motor M1L are supported so as to be rotatable around the steering shaft 215L whose axial direction is a direction intersecting (orthogonal to) the sheet conveyance direction V and a width direction W orthogonal to the sheet conveyance direction V, and the registration driving roller 212R and the registration drive motor M1R are supported so as to be rotatable around the steering shaft 215R whose axial direction is the direction intersecting (orthogonal to) the sheet conveyance direction V and the width direction W.

On the other hand, the steering motors M2L and M2R are disposed in axial directions parallel to the axial directions of the steering shafts 215L and 215R, respectively, and the motor gears 213L and 213R are fixed to rotation shafts of the steering motors M2L and M2R, respectively. The drive input gears 214L and 214R respectively fixed to the steering shafts 215L and 215R are meshed with the motor gears 213L and 213R, respectively. As a result, the control unit 201 can drive the steering motors M2L and M2R to turn (rotate) the registration driving rollers 212L and 212R and the registration drive motors M1L and M1R around the steering shafts 215L and 215R, respectively.

In short, the registration driving rollers 212L and 212R are rotationally driven by the control unit 201 driving the registration drive motors M1L and M1R. In addition, the registration driving rollers 212L and 212R are turned in a direction inclined with respect to the sheet conveyance direction V by the control unit 201 driving the steering motors M2L and M2R. As a result, each of the registration roller pairs 240L and 240R can independently change a conveyance speed and can independently change the conveyance direction.

The home position sensor SN3L serving as a first reference position detection unit and the home position sensor SN3R serving as a second reference position detection unit are disposed in the vicinity of the registration driving rollers 212L and 212R, respectively. As described below in detail, the home position sensors SN3L and SN3R detect sensor home positions (a first reference position and a second reference position), thereby controlling the registration driving rollers 212L and 212R to move to home positions. The home positions of the registration driving rollers 212L and 212R are positions (steering initial positions) where the registration roller pairs 240L and 240R are oriented straight (without inclination) in the conveyance direction. That is, a steering initial setting operation of returning the registration roller pairs 240L and 240R to positions where the registration roller pairs 240L and 240R are not inclined with respect to the conveyance direction can be performed according to detection results of the home position sensors SN3L and SN3R.

Configuration for Detection of Skew Feeding of Sheet

The leading edge registration sensors SN2L and SN2R serving as skew feeding detection units implemented by, for example, optical sensors or the like are disposed at the same position in the sheet conveyance direction V (that is, so as to be aligned in the width direction W) in the vicinity of a nip of each of the registration roller pairs 240L and 240R. The control unit 201 (see FIG. 1B) calculates a skew feeding amount of the sheet S conveyed to the registration unit 210 from a difference in timing at which each of the leading edge registration sensors SN2L and SN2R detects a leading edge of the sheet S and a conveyance speed at which the sheet Sis conveyed. In the present embodiment, the skew feeding amount of the sheet S is detected by the plurality of leading edge registration sensors SN2L and SN2R. However, the present technology is not limited thereto, and other methods such as detecting the skew feeding of the sheet S by analyzing an image using an image sensor or the like that captures the image may be used.

Configuration for Detection of Position of Sheet in Width Direction

The image sensor SN1L serving as a width direction position detection unit is disposed upstream of the registration roller pair 240L in the sheet conveyance direction V. The image sensor SN1R serving as a width direction position detection unit is disposed downstream of the registration roller pair 240R in the sheet conveyance direction V. The image sensor SN1L detects an edge position of a left end portion of the sheet S, and the image sensor SN1R detects an edge position of a right end portion of the sheet S. For example, optical sensors such as CIS sensors can be used as the image sensors SN1L and SN1R. Then, the control unit 201 calculates a position (so-called lateral registration position) of the sheet S in the width direction of the sheet S conveyed to the registration unit 210 based on the edge positions of the left end portion and the right end portion.

In the present embodiment, a case where the two image sensors SN1L and SN1R detect both end positions of the sheet S in the width direction W has been described. However, the present technology is not limited thereto, and one image sensor longer in the width direction W than a range through which the sheet S passes may be used. In addition, a position of one end portion of the sheet S may be detected by one image sensor, and the position of the sheet S in the width direction may be calculated from, for example, a sheet size input to the control unit 201 (or detected at another portion). Furthermore, a configuration in which a position of one end portion of the sheet S is detected by one image sensor, and movement (lateral registration) of the sheet S in the width direction W is controlled using the position of the one end portion as a reference position is also applicable.

Skew Feeding Correction Operation

Figure 4A:
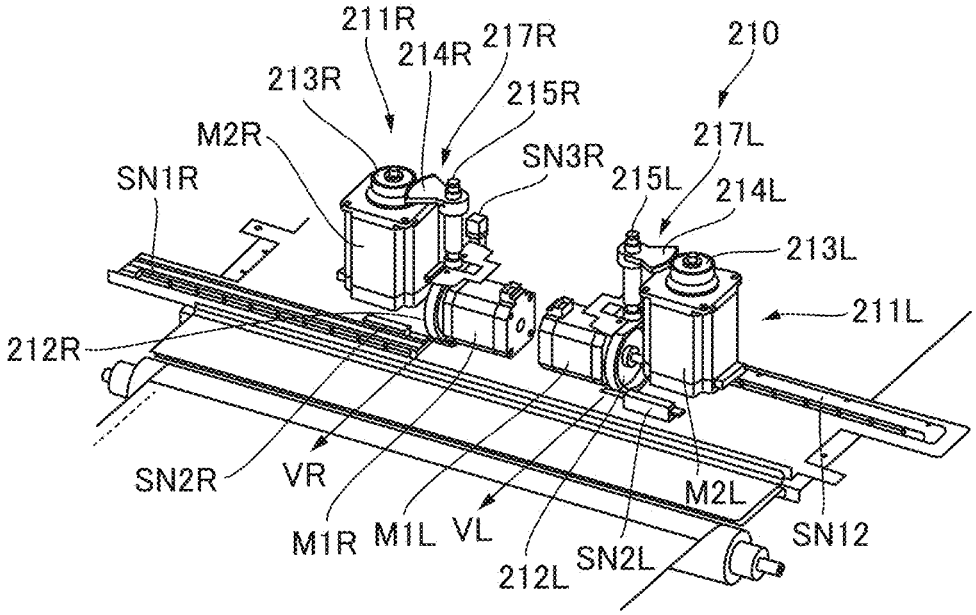
FIG. 4A is a perspective view illustrating the registration unit before a registration driving roller is turned.
Figure 4B:
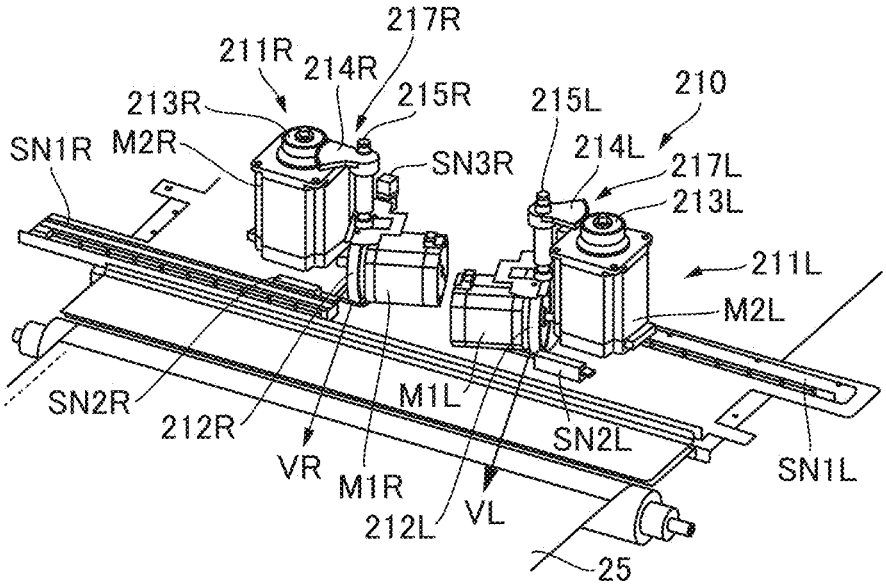
FIG. 4B is a perspective view illustrating the registration unit after the registration driving roller is turned.
Figure 5A:
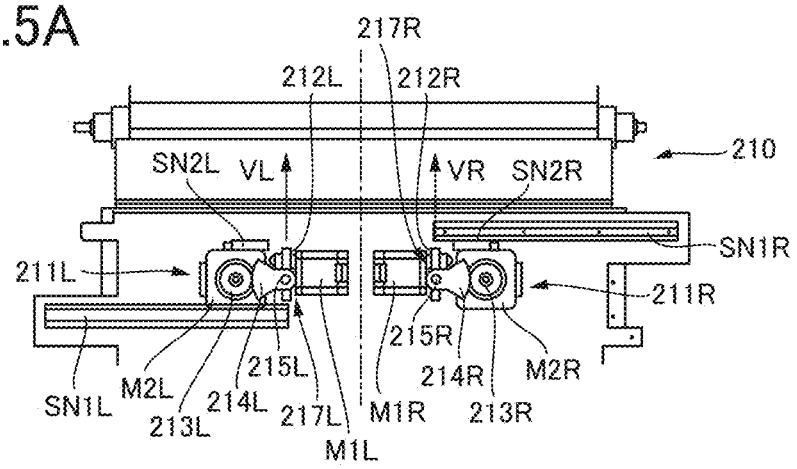
FIG. 5A is a top view illustrating the registration unit before a sheet is conveyed.
Figure 5B:
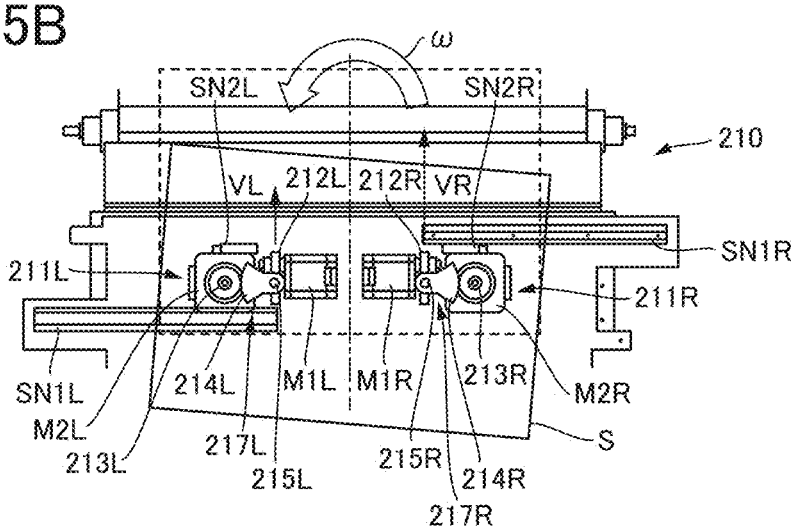
FIG. 5B is a top view illustrating the registration unit in a state in which skew feeding correction for a sheet is performed.
Figure 5C:
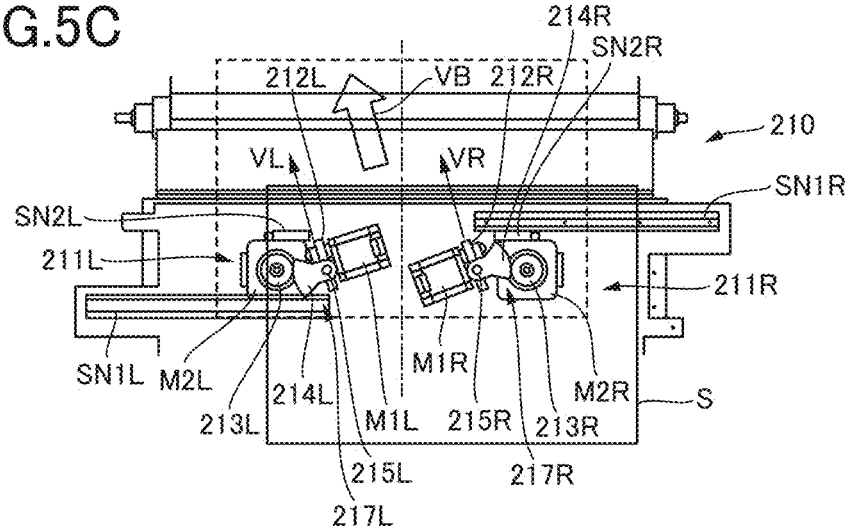
FIG. 5C is a top view illustrating the registration unit in a state in which lateral registration correction for a sheet is performed.

Next, the principle of a skew feeding correction operation (active registration operation) will be described with reference to FIGS. 4A, 4B, 5A, 5B, 5C, 7A, 7B, and 7C. FIG. 4A is a perspective view illustrating the registration unit before the registration driving roller is turned. FIG. 4B is a perspective view illustrating the registration unit after the registration driving roller is turned. FIG. 5A is a top view illustrating the registration unit before the sheet is conveyed. FIG. 5B is a top view illustrating the registration unit in a state in which skew feeding correction for the sheet is performed. FIG. 5C is a top view illustrating the registration unit in a state in which the lateral registration correction for the sheet is performed. FIG. 7A is a schematic diagram illustrating a skew feeding amount measurement example. FIG. 7B is a diagram illustrating an example of a skew feeding correction profile. FIG. 7C is a schematic diagram illustrating the skew feeding correction operation. In the skew feeding correction, an angle of a traveling direction of the sheet is corrected such that the traveling direction becomes parallel to the conveyance center which is the center of the conveyance path for conveying the sheet in the width direction.

In the registration unit 210, as described above, the registration driving rollers 212L and 212R are independently driven by the registration drive motors M1L and M1R, and the rotational speeds of the registration driving rollers 212L and 212R can be independently changed. The control unit 201 (see FIG. 1B) determines the skew feeding correction profile for correcting the skew feeding of the sheet based on an inclination angle of the sheet detected by the leading edge registration sensors SN2L and SN2R. The skew feeding correction profile is a control amount for controlling a speed difference between the registration driving rollers 212L and 212R. Then, the control unit 201 drives the registration drive motors M1L and M1R based on the skew feeding correction profile to rotate the registration driving rollers 212L and 212R.

Here, the skew feeding correction profile will be described. For example, in a case where the skew feeding correction is not performed as illustrated in FIGS. 4A and 5A, the registration driving rollers 212L and 212R are oriented in a conveyance direction X and are rotated to convey the sheet at the same speeds VL and VR. Here, the sheet is conveyed, and the skew feeding amount of the sheet is detected by the leading edge registration sensors SN2L and SN2R, for example, as illustrated in FIGS. 4B and 7A. Then, the control unit 201 creates the skew feeding correction profile as illustrated in FIG. 7B according to the detected skew feeding amount. The skew feeding correction profile is created as a speed table such that the skew feeding amount detected by the leading edge registration sensors SN2L and SN2R is equivalent to a difference between an integral value of a speed LVx of the registration driving roller 212L and an integral value of a speed RVx of the registration driving roller 212R. That is, as illustrated in FIG. 7B, the skew feeding correction profile is set by multiplying a coefficient corresponding to the skew feeding amount. The control unit 201 drives the registration drive motors M1L and M1R according to the skew feeding correction profile created in this manner. As a result, as illustrated in FIGS. 5B and 7C, a speed difference is caused between the registration driving roller 212L rotationally driven by the registration drive motor M1L and the registration driving roller 212R rotationally driven by the registration drive motor M1R. Therefore, the sheet conveyed by the registration driving rollers 212L and 212R rotates, so that skew feeding is corrected. Although curve driving is used is used in the example of the skew feeding correction profile illustrated in FIG. 7B, triangular driving, trapezoidal driving, or the like may also be used.

Lateral Registration Deviation Correction Operation

Figure 12:
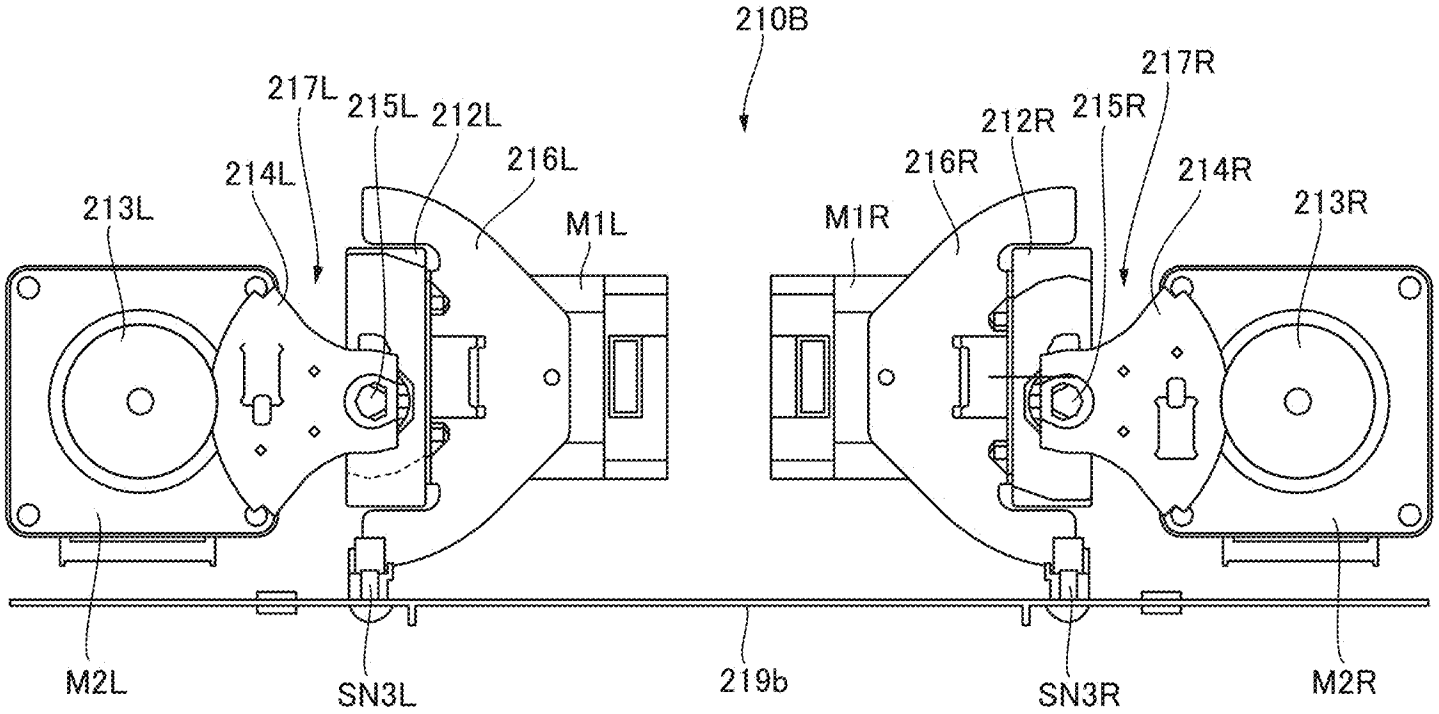
FIG. 12 is a top view illustrating a configuration supported by the registration drive block according to the present embodiment.

Next, the principle of a lateral registration deviation correction operation (steering operation) will be described with reference to FIGS. 8A, 8B, 8C, and 12. FIG. 8A is a schematic diagram illustrating a lateral registration deviation amount measurement example. FIG. 8B is a diagram illustrating an example of a lateral registration deviation correction profile. FIG. 8C is a schematic diagram illustrating the lateral registration deviation correction operation. FIG. 12 is a diagram illustrating an example of a correction profile when lateral registration deviation correction is performed.

A vertical direction in FIG. 8A is the sheet conveyance direction X, and a horizontal direction in FIGS. 8A and 8B is the width direction Z orthogonal to the conveyance direction X. In the lateral registration deviation correction, the position of the sheet in the width direction is corrected so as to match a position for image formation in the width direction. In many cases, the center of the sheet in the width direction matches the center (reference position) of the conveyance path in the width direction. The present technology is not limited thereto in a case where a position of the image formed on the sheet by the image forming unit (recording unit 230) in the width direction does not match the center of the conveyance path in the width direction.

As described above, the conveyance directions of the registration driving rollers 212L and 212R can be changed with the steering shafts 215L and 215R as fulcrums via the drive input gears 214L and 214R by the steering motors M2L and M2R, respectively. For example, when the skew feeding correction for the sheet is not performed, an operation is performed such that the speeds VL and VR and the conveyance directions of the registration driving rollers 212L and 212R become the same as each other. The control unit 201 determines a profile serving as a control amount for correcting the lateral registration deviation based on the positions of the end portions of the sheet detected by the image sensors SN1L and SN1R. That is, the control unit 201 determines profiles of the steering motors M2L and M2R for changing the conveyance directions of the registration driving rollers 212L and 212R.

Here, the lateral registration deviation correction profile will be described. As illustrated in FIG. 8A, the image sensors SN1L and SN1R detect a lateral deviation amount which is a positional deviation in the width direction. Then, the control unit 201 creates the profile of the lateral registration deviation correction (a speed of a Z-direction component) as illustrated in FIG. 8B according to the detected lateral deviation amount. The lateral registration deviation correction profile is created as a speed table such that the detected lateral deviation amount is equivalent to an integral value of a speed Vz of a roller as a component in the width direction Z in a correction section set in advance. That is, as illustrated in FIG. 8B, the lateral registration deviation correction profile is set by multiplying a coefficient corresponding to the lateral deviation amount.

In a case where the lateral registration deviation correction and the skew feeding correction are not simultaneously performed, a speed Vx of the roller as a component in the conveyance direction X is desirably the same as the conveyance speed of the print belt unit 220 disposed downstream in the conveyance direction X. When the speed Vx of the roller as the component in the conveyance direction X and the speed Vz of the roller as the component in the width direction Z are determined, angles θ of the rollers and the speeds VL and VR of the rollers can be calculated from the speed Vx and the speed Vz using a trigonometric function as illustrated in FIG. 8C. An operation profile of the steering motors M2L and M2R and the registration drive motors M1L and M1R can be created by obtaining angles θL and θR and the speeds VL and VR of the rollers per unit time, respectively. The steering motors M2L and M2R and the registration drive motors M1L and M1R are driven according to the profile. As a result, as illustrated in FIGS. 4B, 5C, and 8C, the registration driving roller 212L is turned by the steering motor M2L, and the registration driving roller 212R is turned by the steering motor M2R. Therefore, the sheet is conveyed while being diagonally fed by the registration driving rollers 212L and 212R, so that the lateral registration deviation is corrected. Although curve driving is used is used also in the example of the speed correction profile illustrated in FIG. 8B, triangular driving, trapezoidal driving, or the like may also be used.

Operation in Print Module

Figure 9:
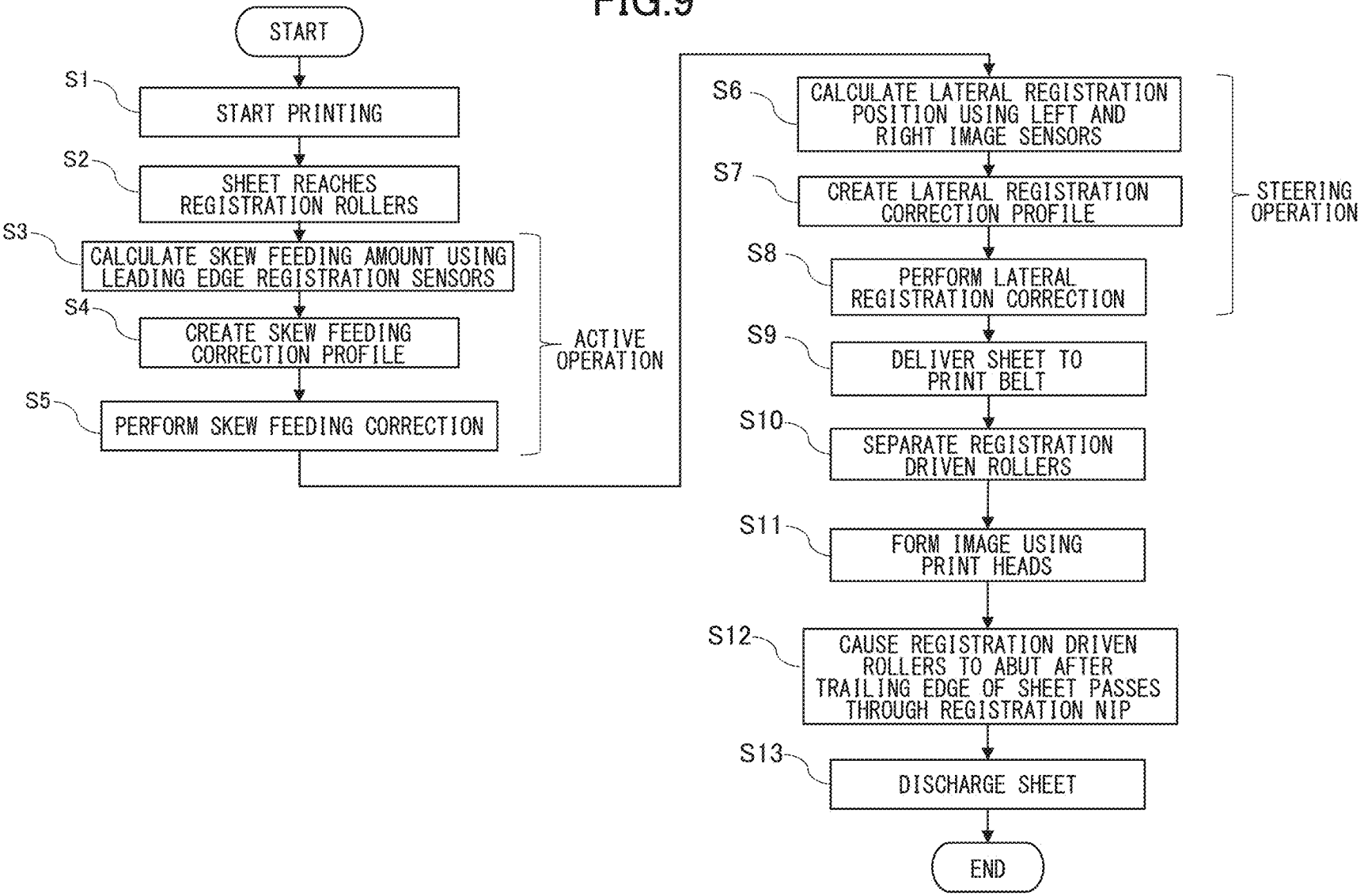
FIG. 9 is a flowchart illustrating control of the print module according to the present embodiment.

Next, an operation of the print module 200 will be described with reference to FIG. 9. FIG. 9 is a flowchart illustrating control of the print module according to the present embodiment. In image formation control illustrated in FIG. 9, an example in which the image is formed on one side of the sheet will be described. However, this control is repeatedly performed even in a case where the image is formed on both sides of the sheet.

In the print module 200, detection results are input to the control unit 201 from the left and right image sensors SN1L and SN1R and the left and right registration sensors SN2L and SN2R. The control unit 201 controls the left and right registration drive motors M1L and M1R and the left and right steering motors M2L and M2R based on the detection results to convey the sheet and perform the skew feeding correction and the lateral registration correction. The skew feeding correction here refers to correcting an inclination with respect to the sheet conveyance direction V, and the lateral registration correction refers to correcting a deviation of the sheet from the reference position in the width direction W. However, in the present embodiment, the registration unit 210 is basically intended to correct skew feeding of the sheet, and it is often necessary to correct the position in the width direction W as a result of correcting the skew feeding of the sheet. Therefore, both of the corrections are also referred to as skew feeding correction in a broad sense.

First, the control unit 201 starts the image formation control illustrated in FIG. 9 at a timing at which a print job is received directly from an operation unit (not illustrated) or from an external computer connected via a network. The print job received by the control unit 201 includes information such as the number of prints designated by a user and the size of the sheet S to be printed. That is, the control unit 201 determines the start of printing according to the received print job (S1).

Next, the control unit 201 selects the sheet S having a size designated by the print job from, for example, any one of the storage compartments 110*a*, 110*b*, and 110*c*, and causes the feeding module 100 to feed the sheet S. Then, the control unit 201 drives a drive motor or the like to convey the sheet S toward the registration unit 210 by the conveyance roller pairs 208 and 209 (see FIG. 2) such that the sheet S reaches the registration roller pairs 240L and 240R (S2).

Subsequently, the control unit 201 calculates and obtains a posture (skew feeding amount) of the sheet S based on detection results input from the leading edge registration sensors SN2L and SN2R (S3). Here, the posture (skew feeding amount) of the sheet S is an inclination angle with respect to the sheet conveyance direction V, more precisely, an inclination angle with respect to the width direction W at the leading edge of the sheet S. Specifically, as described above, the control unit 201 obtains the inclination angle of the sheet S based on a difference between timings at which the two leading edge registration sensors SN2L and SN2R detect the leading edge of the conveyed sheet S and the conveyance speed of the sheet S.

Next, the control unit 201 creates the skew feeding correction profile (see FIG. 7B) of the registration roller pairs 240L and 240R for correcting the skew feeding of the sheet S based on the inclination angle of the sheet S obtained as described above (S4). Then, the control unit 201 performs the skew feeding correction (active operation) according to the skew feeding correction profile (S5).

Specifically, the registration drive motors M1L and M1R are driven according to the skew feeding correction profile based on an instruction from the control unit 201, whereby the rotational speeds of the registration roller pairs 240L and 240R are independently controlled. For example, in a state illustrated in FIGS. 4A and 5A, the registration drive motors M1L and M1R are controlled such that the registration roller pair 240L has the speed VL and the registration roller pair 240R has the speed VR. Here, as illustrated in FIG. 5B, the inclination angle of the sheet S conveyed while being skewed is detected, the skew feeding correction profile is created, and the registration drive motors M1L and M1R are independently driven and controlled according to the skew feeding correction profile. Then, the speed VR of the registration roller pair 240R is controlled to be higher than the speed VL of the registration roller pair 240L. As a result, the sheet S is turned as indicated by an arrow ω, and the skew feeding of the sheet S is corrected as indicated by a broken line in the drawing.

Next, as illustrated in FIG. 9, the control unit 201 calculates the lateral registration position (lateral deviation amount) of the sheet S, that is, both end positions of the sheet S in the width direction W, based on detection by the left and right image sensors SN1L and SN1R (S6). Specifically, the control unit 201 detects both end positions of the sheet S in the width direction W by detecting to which portions of the image sensors SN1L and SN1R the sheet S covers, and calculates the lateral deviation amount of the sheet S from the both end positions.

Subsequently, the control unit 201 creates the lateral registration correction profile (see FIG. 8B) of the registration roller pairs 240L and 240R for correcting the lateral registration (lateral deviation) of the sheet S based on the calculated lateral registration position of the sheet S (S7). Then, the control unit 201 performs the lateral registration correction (steering operation) according to the lateral registration correction profile (S8).

Specifically, the steering motors M2L and M2R are driven according to the lateral registration correction profile based on an instruction from the control unit 201, whereby turning angles of the registration roller pairs 240L and 240R are independently controlled. In a state illustrated in FIGS. 4A and 5A, the steering motors M2L and M2R control angles of the registration driving rollers 212L and 212R such that the registration driving rollers 212L and 212R move to the home positions based on the detection results of the home position sensors SN3L and SN3R described above. Therefore, the registration roller pairs 240L and 240R are controlled to be oriented straight in the conveyance direction. Here, as illustrated in FIG. 5C, the lateral registration position of the sheet S that has been conveyed while laterally deviating is detected, the lateral registration correction profile is created, and the steering motors M2L and M2R are independently driven and controlled according to the lateral registration correction profile. Then, each of the registration roller pairs 240L and 240R is turned and controlled such that the sheet S is conveyed in a direction in which the sheet S is turned at the speed VL by the registration roller pair 240L and the sheet S is conveyed in a direction in which the sheet S is turned at the speed VR by the registration roller pair 240R. As a result, the sheet S is conveyed while moving in the width direction W as indicated by an arrow VB, and correction is performed such that the lateral registration position of the sheet S becomes the reference position (a position matching the conveyance center) as indicated by a broken line in the drawing. In the lateral registration correction, control is performed such that the speeds VL and VR of the registration roller pairs 240L and 240R become the same speed, and the turning angles become the same angle in a normal state in which the skew feeding correction is not performed.

Next, as illustrated in FIG. 9, the control unit 201 delivers the sheet S to the print belt 25 (see FIG. 2) after the end of the lateral registration correction (S9). Then, after the sheet S is delivered to the print belt 25, the registration driven rollers 252L and 252R are separated from the registration driving rollers 212L and 212R by the separation mechanism (not illustrated) (S10).

Subsequently, the control unit 201 causes the recording unit 230 to form the image on the sheet S (S11). After a trailing edge of the sheet S passes through the nip (registration nip) of each of the registration roller pairs 240L and 240R, the registration driven rollers 252L and 252R abut on the registration driving rollers 212L and 212R by the separation mechanism (not illustrated) (S12). Then, the sheet S is discharged toward the discharge module 700 (see FIG. 1) (S13), the print job ends in this way, and an image forming operation for one sheet ends.

In the case of the duplex printing in which the images are formed on both sides (a front side and a back side) of the sheet S, the control unit 201 reverses the sheet S by the reversing module 600 after the operation in step S13, and conveys the sheet S again toward the registration roller pairs 240L and 240R. Then, the operations of step S2 and subsequent steps are similarly performed.

Furthermore, in the flowchart illustrated in FIG. 9, the skew feeding correction (active operation) and the lateral registration correction (steering operation) are separately performed, but the skew feeding correction and the lateral registration correction may be combined to be performed at the same time.

Figure 10:
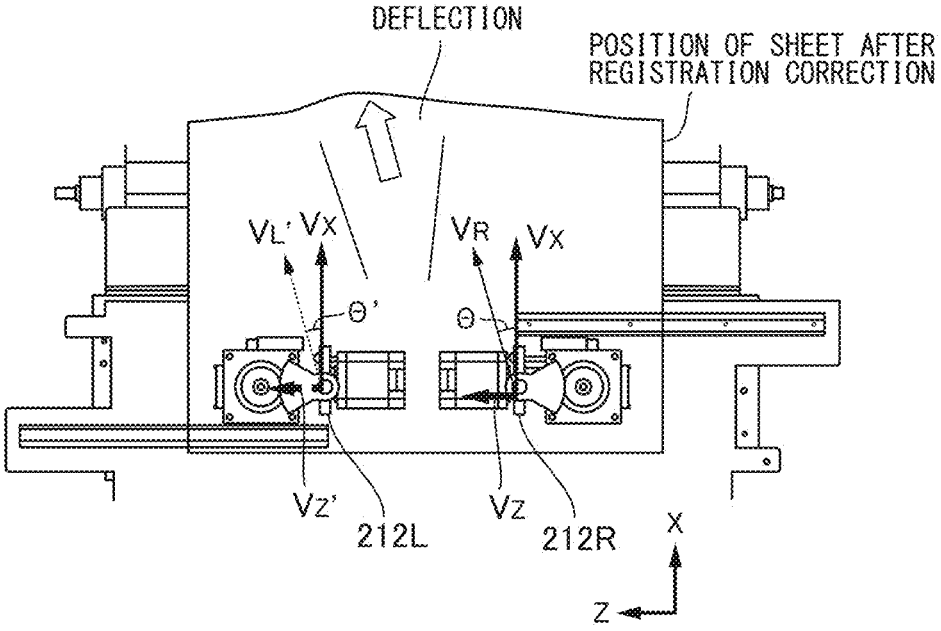
FIG. 10 is an explanatory diagram for describing a case where parallelism of the registration driving rollers according to the present embodiment is not favorable.

Influence on Parallelism of Registration Driving Rollers and Accuracy of Lateral Registration Correction Here, an influence on accuracy of the lateral registration correction for the sheet in a case where the parallelism of the registration driving rollers 212L and 212R is not favorable will be described with reference to FIG. 10. FIG. 10 is an explanatory diagram for describing a case where the parallelism of the registration driving rollers according to the present embodiment is not favorable.

As illustrated in FIG. 10, it is assumed that the orientations of the registration driving rollers 212L and 212R, that is, the angles of the registration driving rollers 212L and 212R turned around the steering shafts 215L and 215R by the steering motors M2L and M2R, are not parallel (see FIG. 2). In this state, when the conveyance speeds are applied to the sheet from the registration driving rollers 212L and 212R in directions indicated by a speed VL' and the speed VR indicated by arrows in FIG. 10, for example, the speed Vx is applied to the sheet in the conveyance direction X. However, there is a difference between a speed Vz' which is a speed in the width direction Z applied from the registration driving roller 212L and the speed Vz which is a speed in the width direction Z applied from the registration driving roller 212R. In particular, as illustrated in FIG. 10, in a case where the speed Vz' is lower than the speed Vz, that is, in a case where the registration driving roller 212L is oriented more toward the conveyance direction X than the registration driving roller 212R, deflection occurs on a leading edge side of the sheet in the conveyance direction due to the speed difference. In a case where the registration driving roller 212R is oriented more toward the conveyance direction X than the registration driving roller 212L, there is a possibility that deflection occurs on a trailing edge side of the sheet in the conveyance direction due to the speed difference.

In a case where the sheet in which such deflection has occurred is conveyed and delivered to the print belt unit 220, the sheet is released from a nip of each of the registration driving rollers 212L and 212R (that is, the registration roller pairs 240L and 240R (see FIG. 6)), and the deflection is eliminated. When the deflection is eliminated in this manner, due to extension of the deflection with respect to the width direction Z, the position of the sheet in the width direction Z deviates, that is, positional accuracy of the lateral registration correction is deteriorated, which means that the accuracy of the lateral registration correction is adversely affected. Therefore, in a case where the registration driving rollers 212L and 212R have a structure capable of being independently turned around the steering shafts 215L and 215R as in the present embodiment, there is a problem that it is necessary to satisfactorily ensure the parallelism therebetween.

By the way, in the case of correcting skew feeding of a sheet by differentiating the rotational speeds of the plurality of skew feeding correction rollers as described above, it is difficult to perform so-called lateral registration correction in which a position of the sheet in the width direction orthogonal to a conveyance direction is moved by the skew feeding correction roller. In this case, it is necessary to provide another mechanism such as a roller pair for performing the lateral registration correction separately from the skew feeding correction roller, as a result of which there is a possibility that a conveyance path in the conveyance direction of the sheet becomes long. Therefore, it is conceivable that the plurality of skew feeding correction rollers is configured to be capable of diagonally feeding the sheet by turning with a direction intersecting (orthogonal to) a surface of the sheet as an axial center while maintaining a parallel state, thereby enabling the lateral registration correction for the sheet.

However, when the skew feeding correction roller is worn or soiled with ink, replacement of the skew feeding correction roller may be required. Since the skew feeding correction rollers have an independent structure, an orientation (reference position) in a turning direction may deviate due to variations in component tolerance or the like after the replacement of the skew feeding correction roller, which may affect accuracy of the lateral registration correction for the sheet. In order to solve such a problem, it is conceivable to align an initial position of the skew feeding correction roller in the turning direction after the replacement. However, when it is required to perform the alignment in a state in which the skew feeding correction roller is attached to the apparatus, there is a problem that workability in replacement work is poor. The present disclosure is directed to provide a sheet conveyance apparatus, an image forming apparatus, and an image forming system capable of improving workability in replacement work for a first skew feeding correction roller and a second skew feeding correction roller and improving accuracy in lateral registration correction.

As described above, for the registration driving rollers 212L and 212R, the sensor home positions of the registration driving rollers 212L and 212R are detected by the home position sensors SN3L and SN3R. Then, the registration driving rollers 212L and 212R are controlled to move to the home positions by the steering motors M2L and M2R based on the detection performed by the home position sensors SN3L and SN3R. For example, in a case where the registration driving roller 212R and/or the registration driving roller 212L is replaced, the parallelism of the registration driving rollers 212L and 212R cannot be ensured unless alignment with the home positions (that is, reference position adjustment) is performed. However, performing the alignment in a state in which the registration driving rollers 212L and 212R are assembled to the registration unit 210 causes work to be performed in a narrow space in a casing of the print module 200, resulting in poor workability. That is, there arises a problem that workability in replacement work for the registration driving rollers 212L and 212R is poor. Therefore, in the present embodiment, such a problem is solved by the configuration as described below.

Registration Drive Block

Figure 11:
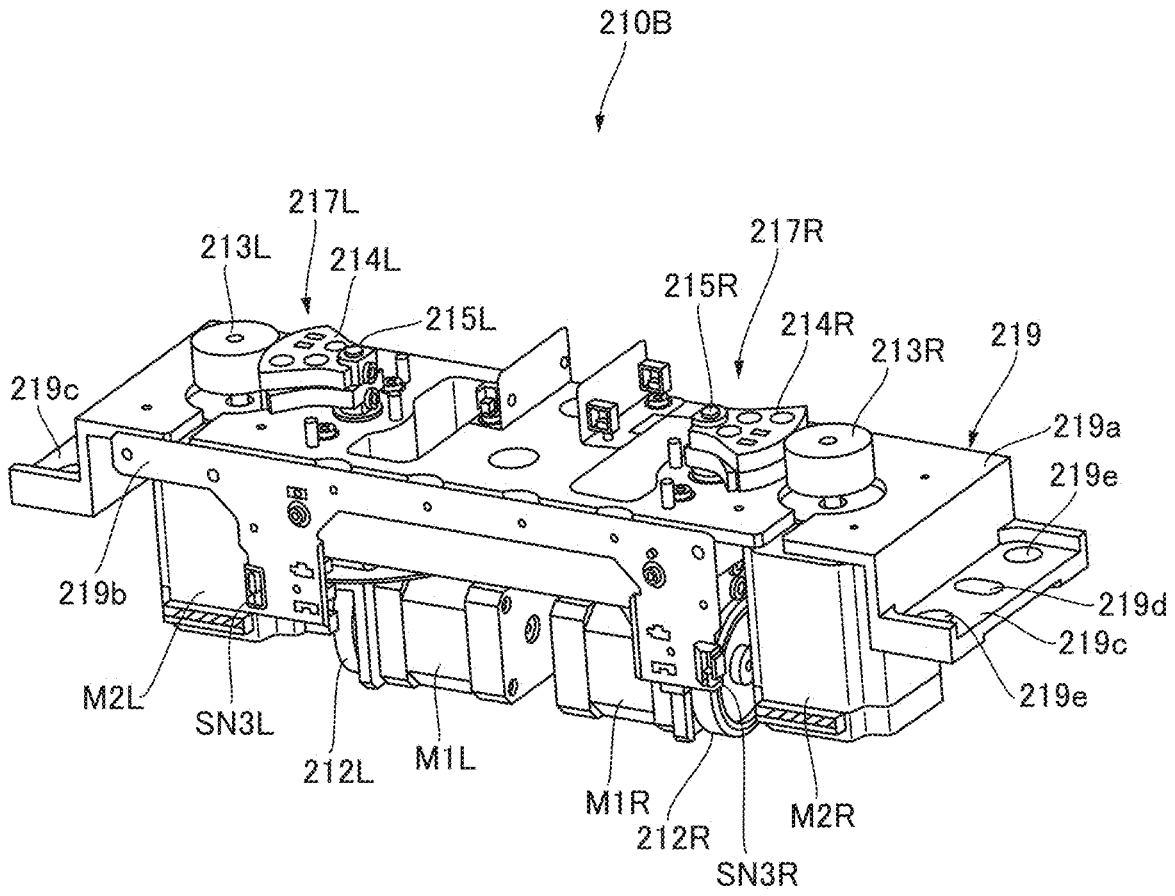
FIG. 11 is a perspective view illustrating a registration drive block according to the present embodiment.
Figure 13:
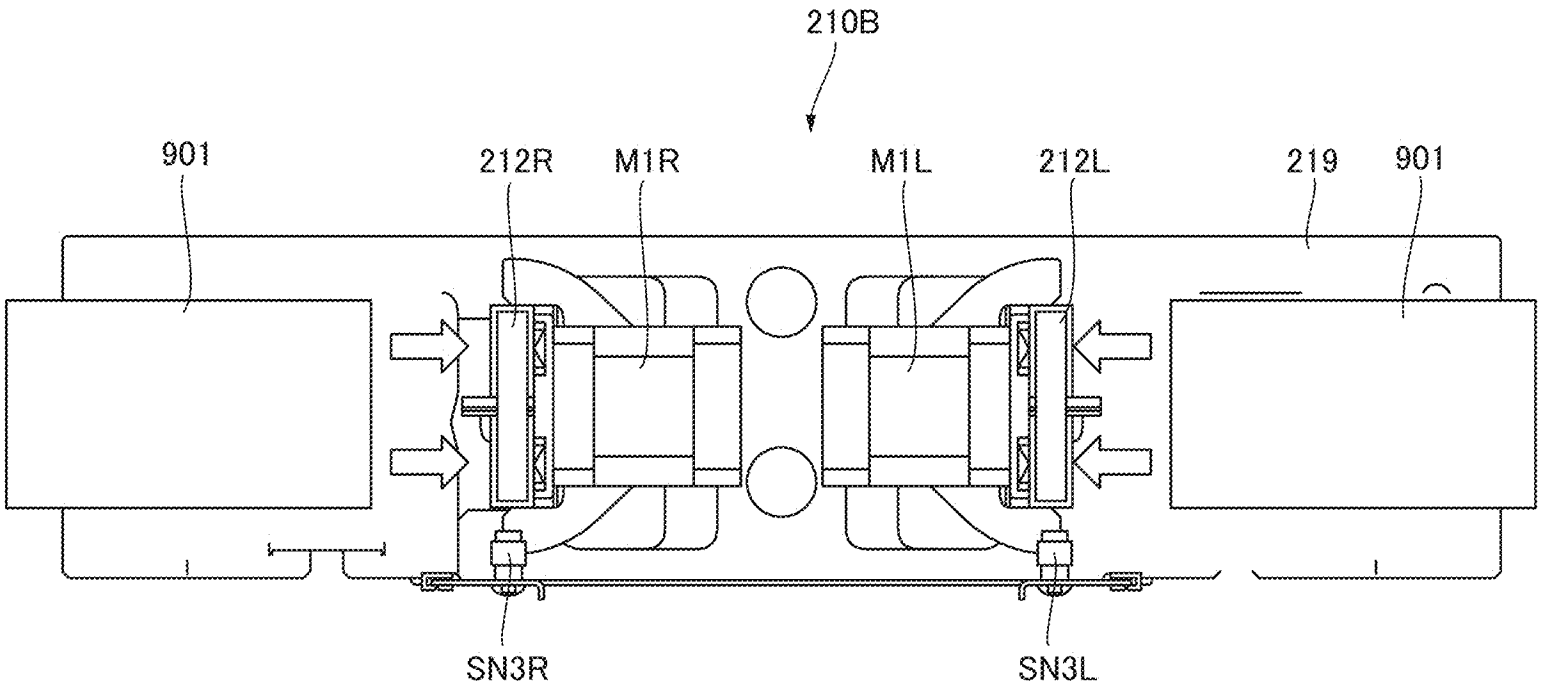
FIG. 13 is a bottom view illustrating a state at the time of adjustment in an assembly process of the registration driving roller according to the present embodiment.
Figure 14:
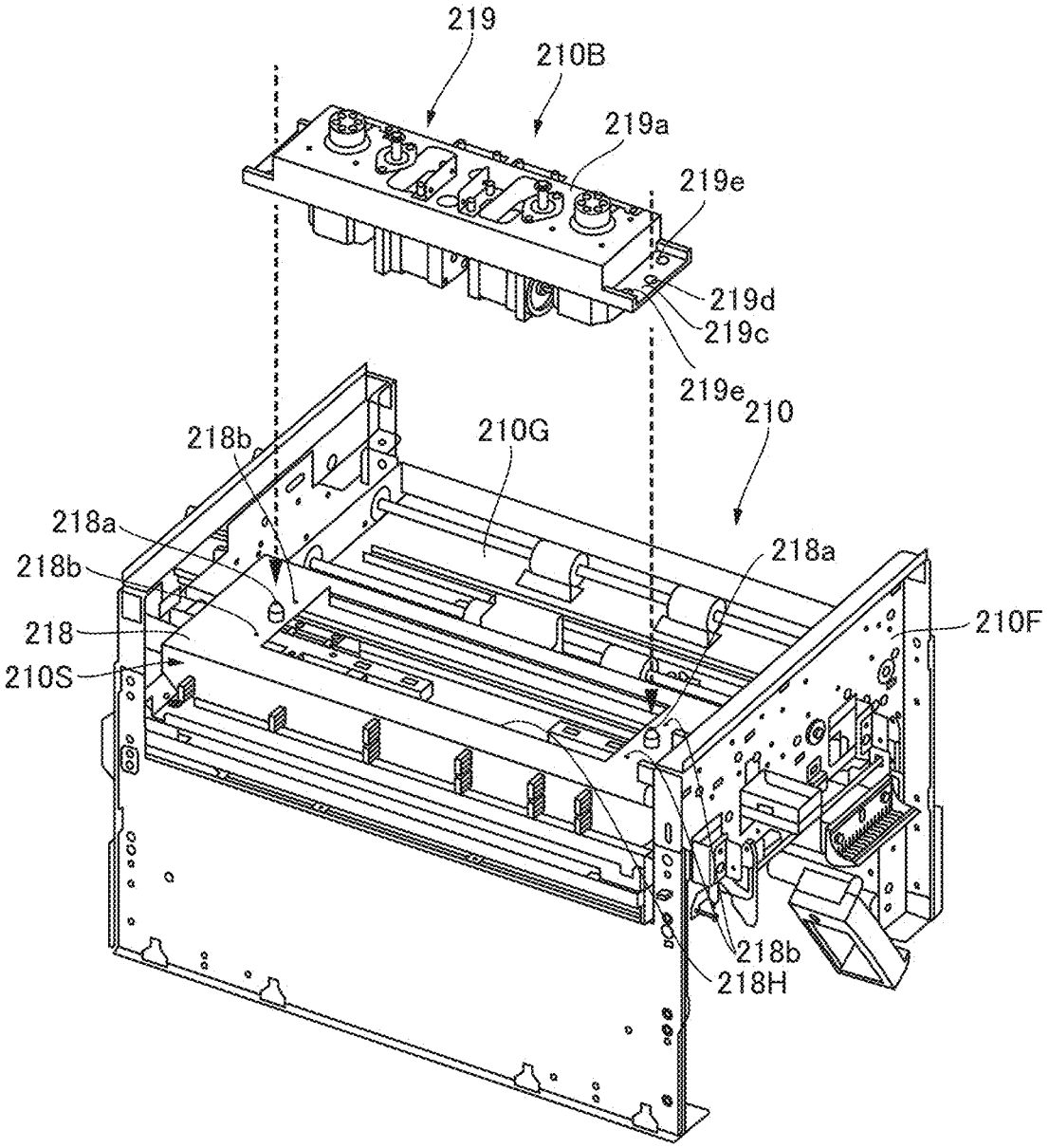
FIG. 14 is an exploded perspective view illustrating the registration unit before the registration drive block according to the present embodiment is assembled.
Figure 15:
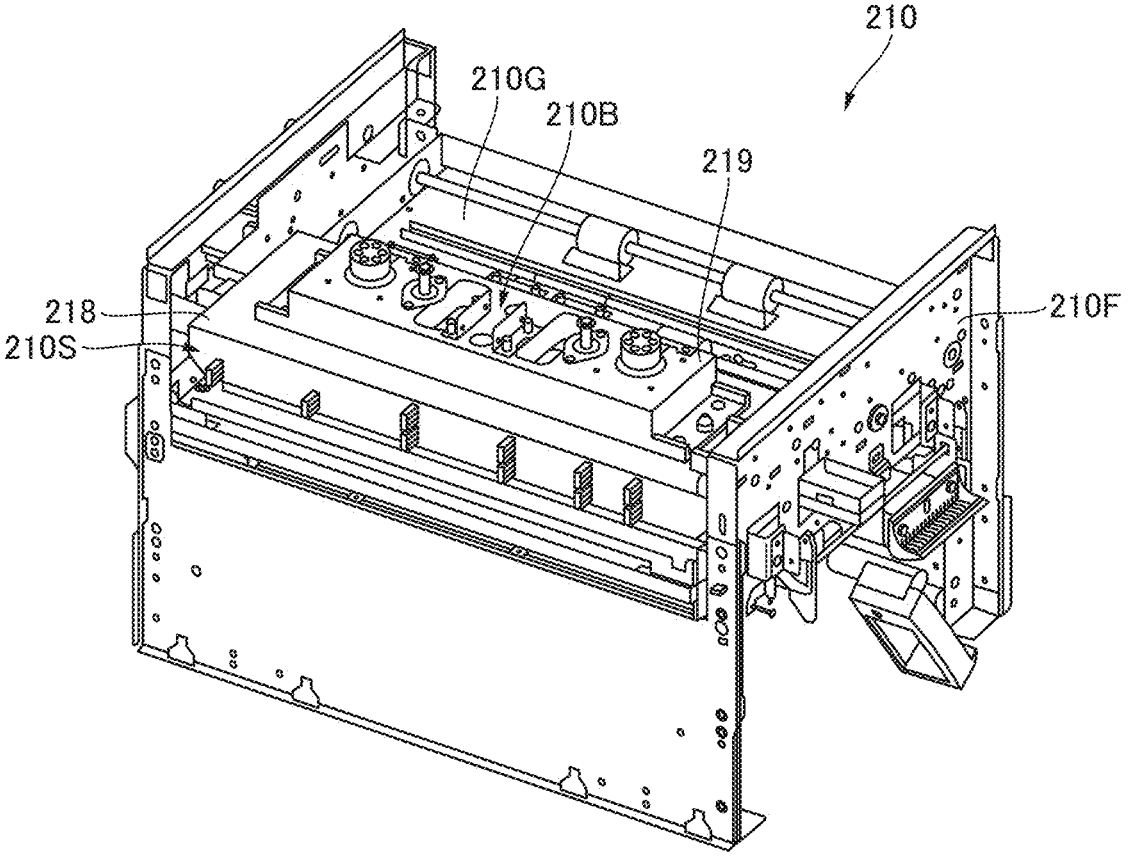
FIG. 15 is a perspective view illustrating the registration unit in a state in which the registration drive block according to the present embodiment is attached.

Next, a registration drive block 210B in which the registration driving rollers 212L and 212R, the registration drive motors M1L and M1R, the steering motors M2L and M2R, the turning transmission mechanisms 217L and 217R, and the like are integrally unitized will be described with reference to FIGS. 11 to 15. FIG. 11 is a perspective view illustrating the registration drive block according to the present embodiment. FIG. 12 is a top view illustrating a configuration supported by the registration drive block according to the present embodiment. FIG. 13 is a bottom view illustrating a state at the time of adjustment in an assembly process of the registration driving roller according to the present embodiment. FIG. 14 is an exploded perspective view illustrating the registration unit before the registration drive block according to the present embodiment is assembled. FIG. 15 is a perspective view illustrating the registration unit in a state in which the registration drive block according to the present embodiment is attached.

Configuration of Registration Drive Block

As illustrated in FIGS. 11 and 12, the registration drive block 210B serving as a roller unit includes a support stay 219 serving as a support member. The support stay 219 roughly includes a stay main body 219*a* and a side plate 219*b*, the stay main body 219*a* is configured as a plate-like frame of the registration drive block 210B, and the side plate 219*b* is attached to a side of the stay main body 219*a*. The registration driving rollers 212L and 212R, the registration drive motors M1L and M1R, the steering motors M2L and M2R, the turning transmission mechanisms 217L and 217R, and the like are attached to the stay main body 219*a* so as to be supported by the stay main body 219*a*. The turning transmission mechanisms 217L and 217R include the motor gears 213L and 213R, the drive input gears 214L and 214R, and the steering shafts 215L and 215R. The side plate 219*b* supports the home position sensors SN3L and SN3R. In addition, the stay main body 219*a* is formed with protrusions 219*c* protruding in a plate shape on both sides of the stay main body 219*a* in the width direction orthogonal to the conveyance direction of the sheet. A through hole 219*d* into which a protruding pin 218*a* (see FIG. 14) formed on a frame 210F of the registration unit 210 of the print module 200 described below is fitted is formed in each of the protrusions 219*c*. Further, screw holes 219*e* for being screwed and fastened to the frame 210F are formed in each of the protrusions 219*c*.

Therefore, the registration driving rollers 212L and 212R, the registration drive motors M1L and M1R, the steering motors M2L and M2R, the turning transmission mechanisms 217L and 217R, and the home position sensors SN3L and SN3R are integrated with each other by being supported by the support stay 219. In short, these configurations are supported by the support stay 219 to form a unit integrated as the registration drive block 210B.

Adjustment of Initial Positions of Registration Driving Rollers in Turning Directions in Registration Drive Block Next, adjustment of initial positions of the registration driving rollers 212L and 212R in the turning directions (steering angles) in the registration drive block 210B will be described. For example, as illustrated in FIG. 12, the registration driving rollers 212L and 212R, the registration drive motors M1L and M1R, the steering motors M2L and M2R, the turning transmission mechanisms 217L and 217R, and the home position sensors SN3L and SN3R are assembled to the support stay 219. That is, the registration drive block 210B is assembled. Then, the assembled registration drive block 210B is set in a measurement tool (measurement instrument) which is not illustrated.

Next, an external controller (not illustrated) is connected to the steering motors M2L and M2R and the home position sensors SN3L and SN3R. Subsequently, the external controller drives and controls the steering motor M2L such that the registration driving roller 212L moves to the sensor home position serving as the first reference position of the home position sensor SN3L. Similarly, the external controller drives and controls the steering motor M2R such that the registration driving roller 212R moves to the sensor home position serving as the second reference position of the home position sensor SN3R.

In this state, as illustrated in FIG. 13, external sensors 901 are set, and measurement of the angles (parallelism) of the registration driving rollers 212L and 212R is started by the external sensors 901. Then, the steering motors M2L and M2R are driven by the external controller (not illustrated), and the angles of the registration driving rollers 212L and 212R detected by the external sensors 901 are controlled such that the registration driving rollers 212L and 212R are parallel to each other. In other words, the steering motors M2L and M2R are driven by the external controller (not illustrated), and the registration driving rollers 212L and 212R are controlled to move to the home positions (steering initial positions) which are positions at which the registration driving rollers 212L and 212R are oriented straight in the conveyance direction. At this time, drive step counts by which the steering motors M2L and M2R are driven, that is, an angle θiL serving as a first turning angle at which the registration driving roller 212L is moved and an angle θiR serving as a second turning angle at which the registration driving roller 212R is moved, are recorded in a barcode label. Then, the barcode label is attached to the registration drive block 210B, for example, and managed as a unique value of the registration drive block 210B.

For example, when the registration drive block 210B is assembled to the registration unit 210 of the print module 200 for component replacement or the like, the angles θiL and θiR described in the barcode label are input to the HDD 201*d* or the like of the control unit 201, for example. The control unit 201 may perform an initial position setting operation of controlling the registration driving rollers 212L and 212R to be positioned at the home positions, for example, when a power supply of the print module 200 is turned on or when the conveyance of the sheet is started. When performing the initial position setting operation, the control unit 201 adds the angles θiL and θiR to the sensor home positions, and turns the registration driving rollers 212L and 212R by the steering motors M2L and M2R. That is, an information regarding the angle θiL corresponds to a first turning angle which is a difference between the sensor home position (i.e., the first reference position) detected by the home position sensor SN3L and the steering initial position (i.e., a first initial position) of the registration driving roller 212L in the turning direction. Also, an information regarding the angle θiR corresponds to a second turning angle which is a difference between the sensor home position (i.e., the second reference position) detected by the home position sensor SN3R and the steering initial position (i.e., a second initial position) of the registration driving roller 212R in the turning direction. As a result, even in a case where there is a variation in parallelism between the registration driving rollers 212L and 212R caused by component tolerance in the registration drive block 210B, the variation is corrected when the registration driving rollers 212L and 212R are controlled to be positioned at the home positions in the initial position setting operation. Therefore, in a state in which the skew feeding correction (lateral registration correction) for the sheet is performed by the registration unit 210, the parallelism of the registration driving rollers 212L and 212R can be maintained with high accuracy.

In the present embodiment, a case where the angles θiL and θiR are recorded in the barcode label and input to the HDD 201*d* or the like has been described, but the drive step counts of the steering motors M2L and M2R may be recorded in the barcode label and input to the HDD 201*d* or the like. That is, a difference in position (angle) between the sensor home positions of the home position sensors SN3L and SN3R and the home positions of the registration driving rollers 212L and 212R may be recorded in the control unit 201. Furthermore, the external sensor 901 may be any sensor as long as the parallelism can be measured, and for example, it is conceivable to use a laser displacement meter, a contact type distance measurement instrument, or the like.

Replacement Work for Registration Drive Block

Next, replacement work for the registration drive block 210B in the print module 200 will be described. For example, in a case where it is necessary to replace the registration driving rollers 212L and 212R due to wear, contamination by ink, or the like, the replacement work of removing the old registration drive block 210B from the registration unit 210 and attaching the new registration drive block 210B is performed.

As illustrated in FIG. 14, the registration unit 210 includes the frame 210F that supports each component, and a guide 210G that comes into contact with a lower surface of the sheet and guides the sheet is supported by the frame 210F. The registration driven rollers 252L and 252R included in the registration roller pairs 240L and 240R are disposed below the guide 210G (see FIG. 6). In addition, an attachment and detachment base 218 that forms an attachment and detachment portion 210S to and from which the registration drive block 210B is attachable and detachable is disposed above the guide 210G. The attachment and detachment base 218 is provided with a plurality of protruding pins 218*a* to be fitted into the through holes 219*d* formed in the support stay 219, and a plurality of screw holes 218*b* into which screws (not illustrated) are screwed, the screws being disposed to penetrate through the plurality of screw holes 219*e*. In addition, a hole portion 218H formed to penetrate through the attachment and detachment base 218 is formed in the attachment and detachment base 218 such that the registration driving rollers 212L and 212R can abut on the registration driven rollers 252L and 252R.

When removing (separating) the old registration drive block 210B, the plurality of (four in the present embodiment) screws (not illustrated) are removed from the screw holes 218*b* and the screw holes 219*e*, respectively, and are separated upward from the attachment and detachment portion 210S of the attachment and detachment base 218. Then, as illustrated in FIG. 14, when attaching (mounting) the new registration drive block 210B, the plurality of screws (not illustrated) is screwed into the screw holes 218*b* and the screw holes 219*e*, respectively, while fitting the protruding pins 218*a* into the through holes 219*d*. As a result, as illustrated in FIG. 15, the support stay 219 of the registration drive block 210B is attached to the attachment and detachment portion 210S of the attachment and detachment base 218.

Summary of Present Embodiment

As described above, the registration unit 210 includes the registration drive block 210B that includes the support stay 219 that supports the registration driving rollers 212L and 212R and the turning transmission mechanisms 217L and 217R, the registration drive block 210B being attachable to and detachable from the attachment and detachment portion 210S. As a result, in the registration drive block 210B, it is possible to eliminate the need for alignment work after replacement of the registration driving rollers 212L and 212R by adjusting the initial positions of the registration driving rollers 212L and 212R in the turning directions. Therefore, workability in replacement work for the registration driving rollers 212L and 212R can be improved, and accuracy of the lateral registration correction can also be improved.

Further, a relative positional relationship between the sensor home positions of the home position sensors SN3L and SN3R can be maintained by the support stay 219 supporting the home position sensors SN3L and SN3R.

In addition, the control unit 201 acquires, from the barcode label or the like, the angle θiL at which the turning direction of the registration driving roller 212L is directed to the home position with respect to the sensor home position detected by the home position sensor SN3L. Similarly, the control unit 201 acquires, from the barcode label or the like, the angle θiR at which the turning direction of the registration driving roller 212R is directed to the home position with respect to the sensor home position detected by the home position sensor SN3R. Then, the initial position setting operation of driving at the angle θiL from the sensor home position of the registration driving roller 212L and driving at the angle θiR from the sensor home position of the registration driving roller 212R is performed. In short, the angles θiL and θiR are acquired by the external sensors 901 before attaching the registration drive block 210B to the registration unit 210. Accordingly, it is possible to accurately control the registration driving rollers 212L and 212R to be positioned at the home positions by performing the initial position setting operation after the replacement. Therefore, the alignment work for the registration driving rollers 212L and 212R after the replacement can be made unnecessary, the workability in replacement work can be improved, the registration driving rollers 212L and 212R can be accurately controlled to be positioned at the home positions, and the accuracy of the lateral registration correction can be improved.

According to the present disclosure, the workability in replacement work for the first skew feeding correction roller and the second skew feeding correction roller can be improved, and the accuracy of the lateral registration correction can also be improved.

Other Embodiments

In the present embodiment described above, in the registration drive block 210B before replacement, deviations of the registration driving rollers 212L and 212R in the turning directions due to a component tolerance is acquired as the angles θiL and θiR by the external sensors 901. In this case, the initial position setting operation is performed after the replacement, and the correction by the angles θiL and θiR is performed, so that the registration driving rollers 212L and 212R are positioned at the home positions. However, the present technology is not limited thereto, and in the registration drive block 210B before replacement, deviations of the registration driving rollers 212L and 212R in the turning directions due to a component tolerance may be measured, and the alignment work may be performed so as to mechanically eliminate the deviation. In this case, the alignment work is required in the registration drive block 210B before replacement. However, the alignment work in the replacement work becomes unnecessary by performing the alignment work in advance before replacement, so that the workability in replacement work can be improved. In addition, since it is not necessary to perform the alignment work in a narrow space after attachment to the registration unit 210, the workability in replacement work can be improved.

In the present embodiment, a case where the registration drive block 210B is attached to the frame 210F via the attachment and detachment base 218 has been described, but the present technology is not limited thereto, and the registration drive block 210B may be directly attached to the frame 210F.

In the present embodiment, a case where the support stay 219 of the registration drive block 210B is attachable to and detachable from the attachment and detachment base 218 has been described. However, the present technology is not limited thereto, and for example, a structure in which parts of the registration drive motors M1L and M1R and the turning transmission mechanisms 217L and 217R are directly fastened to the attachment and detachment base 218 or the frame 210F may be adopted.

In addition, in the present embodiment, a case where the registration drive motors M1L and M1R are supported by the support stay 219 of the registration drive block 210B has been described. However, the present technology is not limited thereto, and the registration drive motors M1L and M1R may be disposed at a portion different from the registration drive block 210B. That is, when the registration drive block 210B is mounted on the attachment and detachment portion 210S, the registration drive motors M1L and M1R may be connected to the registration driving rollers 212L and 212R in a drivable manner.

In addition, in the present embodiment, a case where the steering motors M2L and M2R are supported by the support stay 219 of the registration drive block 210B has been described. However, the present technology is not limited thereto, and the steering motors M2L and M2R may be disposed at a portion different from the registration drive block 210B. That is, when the registration drive block 210B is mounted on the attachment and detachment portion 210S, the steering motors M2L and M2R may be connected to the turning transmission mechanisms 217L and 217R in a drivable manner.

In addition, in the present embodiment, a configuration in which the registration drive block 210B is attachable to and detachable from the attachment and detachment portion 210S formed in the attachment and detachment base 218 has been described. However, the present technology is not limited thereto, and the attachment and detachment portion 210S may be formed on the guide 210G, for example. Furthermore, for example, in a case where there is a unit in which the registration driven rollers 252L and 252R are disposed, the attachment and detachment portion 210S may be formed on the unit. That is, the attachment and detachment portion 210S may be formed so as to be relatively positioned with respect to the frame 210F and be attachable to and detachable from the registration unit 210.

Furthermore, in the present embodiment, a case where the registration unit 210 performs the skew feeding correction at a position upstream of the recording unit 230 serving as the image forming unit in the sheet conveyance direction has been described. However, the present technology is not limited thereto, and for example, the skew feeding correction may be performed at a position upstream of an image reading unit that reads the image of the sheet, a punching unit that forms a hole in the sheet, a folding unit that folds the sheet, or the like in the sheet conveyance direction. In short, the sheet conveyance apparatus that performs the skew feeding correction may be any apparatus or may be incorporated in any apparatus.

While the present disclosure has been described with reference to embodiments, it is to be understood that the present disclosure is not limited to the disclosed embodiments. The scope of the following claims is to be accorded the broadest interpretation so as to encompass all such modifications and equivalent structures and functions.

This application claims the benefit of Japanese Patent Application No. 2024-091194, filed Jun. 5, 2024 which is hereby incorporated by reference herein in its entirety.

What is claimed is:

1. A sheet conveyance apparatus comprising:

a skew feeding correction unit configured to correct skew feeding of a sheet, wherein the skew feeding correction unit includes:

a roller unit; and an attachment and detachment portion to and from which the roller unit is attachable and detachable, and the roller unit includes:

a first skew feeding correction roller configured to convey the sheet;

a second skew feeding correction roller configured to convey the sheet;

a first turning mechanism configured to turn the first skew feeding correction roller around a first shaft extending in an intersecting direction intersecting a conveyance direction of the sheet and a width direction orthogonal to the conveyance direction;

a second turning mechanism configured to turn the second skew feeding correction roller around a second shaft extending in the intersecting direction; and a support member supporting the first skew feeding correction roller, the first turning mechanism, the second skew feeding correction roller, and the second turning mechanism.

2. The sheet conveyance apparatus according to claim 1, wherein the support member is attachable to and detachable from the attachment and detachment portion.

3. The sheet conveyance apparatus according to claim 1, wherein the roller unit includes:

a first reference position detection unit configured to detect a first reference position of the first skew feeding correction roller in a turning direction; and a second reference position detection unit configured to detect a second reference position of the second skew feeding correction roller in a turning direction, and wherein the support member supports the first reference position detection unit and the second reference position detection unit.

4. The sheet conveyance apparatus according to claim 3, further comprising a control unit configured to:

acquire information regarding a first turning angle which is a difference between the first reference position detected by the first reference position detection unit and a first initial position of the first skew feeding correction roller in the turning direction;

acquire information regarding a second turning angle which is a difference between the second reference position detected by the second reference position detection unit and a second initial position of the second skew feeding correction roller in the turning direction; and perform an initial position setting operation of driving the first skew feeding correction roller at the first turning angle from the first reference position and driving the second skew feeding correction roller at the second turning angle from the second reference position.

5. The sheet conveyance apparatus according to claim 1, wherein the roller unit includes:

a first turning drive motor configured to turn the first skew feeding correction roller by driving the first turning mechanism; and a second turning drive motor configured to turn the second skew feeding correction roller by driving the second turning mechanism, and wherein the support member supports the first turning drive motor and the second turning drive motor.

6. The sheet conveyance apparatus according to claim 5, further comprising:

a width direction position detection unit configured to detect a position, in the width direction, of the sheet conveyed to the skew feeding correction unit; and a control unit configured to correct the position of the sheet in the width direction by turning the first skew feeding correction roller by the first turning drive motor and turning the second skew feeding correction roller by the second turning drive motor, based on a detection result of the width direction position detection unit.

7. The sheet conveyance apparatus according to claim 1, wherein the roller unit includes:

a first rotation drive motor configured to rotationally drive the first skew feeding correction roller; and a second rotation drive motor configured to rotationally drive the second skew feeding correction roller, and wherein the support member supports the first rotation drive motor and the second rotation drive motor.

8. The sheet conveyance apparatus according to claim 7, further comprising:

a skew feeding detection unit configured to detect a skew feeding amount of the sheet conveyed to the skew feeding correction unit; and a control unit configured to correct skew feeding of the sheet by causing a speed difference between the first skew feeding correction roller rotationally driven by the first rotation drive motor and the second skew feeding correction roller rotationally driven by the second rotation drive motor, based on a detection result of the skew feeding detection unit.

9. An image forming apparatus comprising:

the sheet conveyance apparatus according to claim 1; and an image forming unit configured to form an image on a sheet conveyed by the sheet conveyance apparatus.

10. An image forming system comprising:

the image forming apparatus according to claim 9; and a processing apparatus configured to perform processing on a sheet on which an image is formed by the image forming apparatus.

* * * * *